US007052119B2

(12) United States Patent
Akahane et al.

(10) Patent No.: US 7,052,119 B2
(45) Date of Patent: May 30, 2006

(54) LIQUID EJECTION HEAD, AND METHOD OF MANUFACTURING THE SAME

(75) Inventors: Fujio Akahane, Nagano (JP); Nagamitsu Takashima, Nagano (JP); Kazushige Hakeda, Nagano (JP); Ryoji Uesugi, Nagano (JP); Akiharu Kurebayashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 103 days.

(21) Appl. No.: 10/647,669

(22) Filed: Aug. 25, 2003

(65) Prior Publication Data

US 2004/0125178 A1 Jul. 1, 2004

(30) Foreign Application Priority Data

Aug. 23, 2002 (JP) ..... 2002-243483
Aug. 8, 2003 (JP) ..... 2003-290643

(51) Int. Cl.
*B41J 2/045* (2006.01)

(52) U.S. Cl. ..... 347/71; 347/68

(58) Field of Classification Search ..... 347/68–72; 29/890.1

See application file for complete search history.

(56) References Cited

U.S. PATENT DOCUMENTS 3,523,224 A * 8/1970 Randall Jr. et al. ..... 361/322
3,895,942 A * 7/1975 Morse ..... 419/19
4,430,784 A * 2/1984 Brooks et al. ..... 29/890.1
5,754,205 A * 5/1998 Miyata et al. ..... 347/70
6,146,915 A * 11/2000 Pidwerbecki et al. ..... 438/21
6,719,410 B1 * 4/2004 Shingai et al. ..... 347/70

FOREIGN PATENT DOCUMENTS

JP 55-014283 A 1/1980
JP 61-73851 A 4/1986
JP 2000-263799 A 9/2000

* cited by examiner

*Primary Examiner*—Manish Shah
*Assistant Examiner*—Geoffrey Mruk
(74) *Attorney, Agent, or Firm*—Sughrue Mion, PLLC

(57) ABSTRACT

A chamber formation plate has a first face formed with a plurality of recesses arranged in a first direction at a fixed pitch such that each of the recesses is communicated with, via a through hole, a second face which is an opposite face of the first face. The chamber formation plate is comprised of nickel. A sealing plate is joined to the first face of the chamber formation plate so as to seal the recesses to form a plurality of pressure generating chambers. A metallic nozzle plate is formed with a plurality of nozzles, and joined to the second face of the chamber formation plate such that each of the nozzles is communicated with associated one of the pressure generating chamber via the through hole. A ratio of a grain size of a crystal of the nickel with respect to a thickness of a partition wall defined between each adjacent ones of the recesses is 60% or less.

22 Claims, 18 Drawing Sheets

FIG. 18A
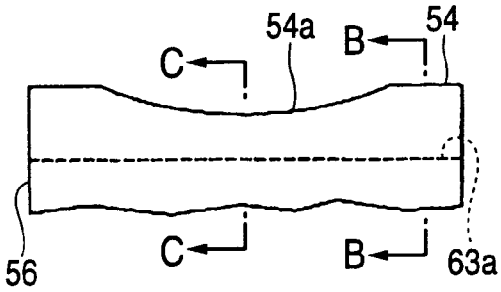
FIG. 18B
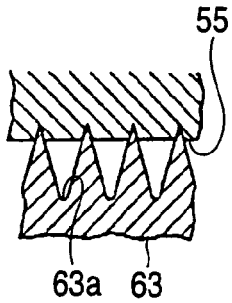
FIG. 18C
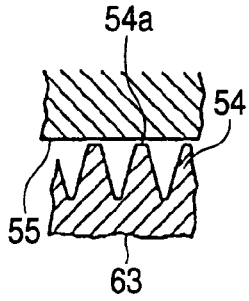
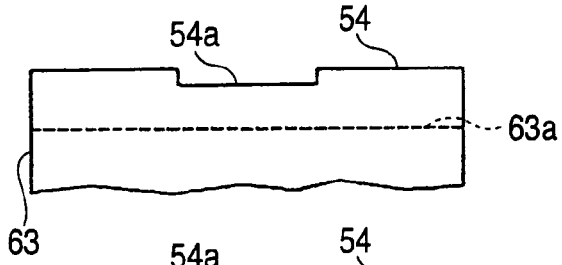
FIG. 18D
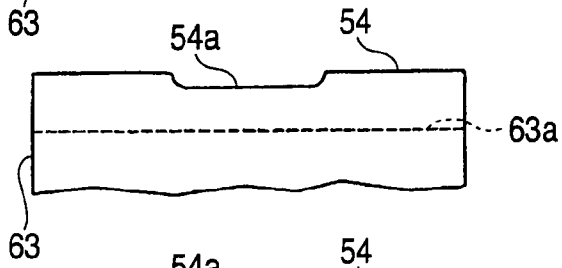
FIG. 18E
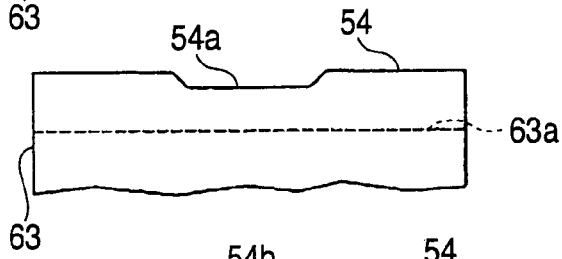
FIG. 18F
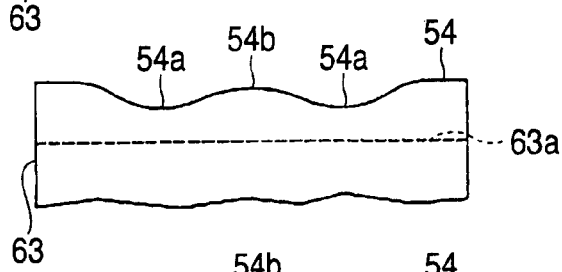
FIG. 18G
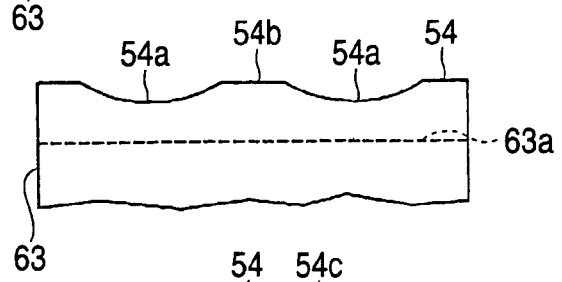
FIG. 18H
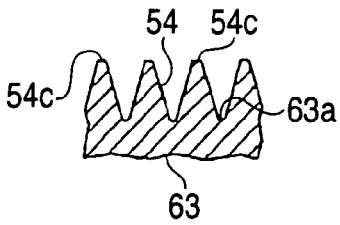
FIG. 18I

LIQUID EJECTION HEAD, AND METHOD OF MANUFACTURING THE SAME

BACKGROUND OF THE INVENTION

The present invention relates to a liquid ejection head in which a chamber formation plate is worked by forging, and to a method of manufacturing such a liquid ejection head.

Forging work is used in various fields of products. For example, it is thought that a pressure generating chamber of a liquid ejection head is molded by forging metal material. The liquid ejection head ejects pressurized liquid from a nozzle orifice as a liquid droplet, and the heads for various liquids have been known. An ink jet recording head is representative of the liquid ejection head. Here, the related art will be described with the ink jet recording head as an example.

An ink jet recording head (hereinafter, referred to as "recording head") used as an example of a liquid ejection head is provided with a plurality of series of flow paths reaching nozzle orifices from a common ink reservoir via pressure generating chambers in correspondence with the orifices. Further, the respective pressure generating chambers need to form by a fine pitch in correspondence with a recording density to meet a request of downsizing. Therefore, a wall thickness of a partition wall for partitioning contiguous ones of the pressure generating chambers is extremely thinned. Further, an ink supply port for communicating the pressure generating chamber and the common ink reservoir is more narrowed than the pressure generating chamber in a flow path width thereof in order to use ink pressure at inside of the pressure generating chamber efficiently for ejection of ink drops.

According to a related-art recording head, a silicon substrate is preferably used in view of fabricating the pressure generating chamber and the ink supply port having such small-sized shapes with excellent dimensional accuracy. That is, a crystal surface is exposed by anisotropic etching of silicon and the pressure generating chamber or the ink supply port is formed to partition by the crystal surface.

Further, a nozzle plate formed with the nozzle orifice is fabricated by a metal board from a request of workability or the like. Further, a diaphragm portion for changing a volume of the pressure generating chamber is formed into an elastic plate. The elastic plate is of a two-layer structure constituted by pasting together a resin film onto a supporting plate made of a metal and is fabricated by removing a portion of the supporting plate in correspondence with the pressure generating chamber. For example, such a structure is disclosed in Japanese Patent Publication No. 2000-263799A.

Meanwhile, according to the above-described related-art recording head, since a difference between linear expansion rates of silicon and the metal is large, in pasting together respective members of the silicon board, the nozzle plate and the elastic plate, it is necessary to adhere the respective members by taking a long time period under relatively low temperature. Therefore, enhancement of productivity is difficult to achieve to bring about a factor of increasing fabrication cost. Therefore, there has been tried to form the pressure generating chamber at the board made of the metal by plastic working, however, the working is difficult since the pressure generating chamber is extremely small and the flow path width of the ink supply port needs to be narrower than the pressure generating chamber to thereby pose a problem that improvement of production efficiency is difficult to achieve.

Under such the circumstances, when the pressure generating chamber is molded by forging work of metal, a problem characteristic of the metal forging work must be solved. The problem is as follows: elongated recess portions for constituting pressure generating chambers in a chamber formation plate aligned side by side are obtained by a forging work while being defined by partition walls. Although these members are extremely minute, desired shape or dimensional accuracy must be secured. To this end, it is necessary to find the parameter values best for forming the elongated recess portions from among parameters of metallic material constituting the chamber formation plate, in order to carry out more improved forging work. If the molding accuracy of the pressure generating chambers is insufficient, when the chamber formation plate is assembled as a flow path unit, accuracy in assembly decreases, which may interfere with ejection performance of ink droplet in an extreme case.

SUMMARY OF THE INVENTION

It is therefore an object of the invention to carry out improved precise forging work for forming a chamber formation plate with excellent accuracy.

In order to achieve the above object, according to the invention, there is provided a liquid ejection head comprising:

a chamber formation plate, having a first face formed with a plurality of recesses arranged in a first direction at a fixed pitch, each of the recesses being communicated with, via a through hole, a second face which is an opposite face of the first face, the chamber formation plate comprised of nickel;

a sealing plate, joined to the first face of the chamber formation plate so as to seal the recesses to form a plurality of pressure generating chambers; and a metallic nozzle plate, formed with a plurality of nozzles, and joined to the second face of the chamber formation plate such that each of the nozzles is communicated with associated one of the pressure generating chamber via the through hole, wherein a ratio of a grain size of a crystal of the nickel with respect to a thickness of a partition wall defined between each adjacent ones of the recesses is 60% or less.

According to the invention, there is also provided a method of manufacturing a liquid ejection head, comprising steps of:

providing a material plate comprised of nickel;

performing a forging work to form a plurality of recesses in a first face of the material plate such that each of the recesses is communicated with, via a through hole, a second face which is an opposite face of the first face;

joining a sealing plate onto the first face of the material plate so as to seal the recesses to form a plurality of pressure generating chambers; and joining a metallic nozzle plate formed with a plurality of nozzles, onto the second face of the material plate such that each of the nozzles is communicated with associated one of the pressure generating chamber via the through hole, wherein a ratio of a grain size of a crystal of the nickel with respect to a thickness of a partition wall defined between each adjacent ones of the recesses is 60% or less.

The partition wall is formed by subjecting material nickel to the plastic flow into a gap of a male die (forging punch) having an extremely small width. Whether the plastic flow is excellently carried out is determined by the grain size of the nickel crystal. Therefore, it is necessary to select the best grain size with respect to an interval of the gap, that is, the thickness of the partition wall.

By setting the ratio as described the above, the crystal becomes smaller than the width of the gap. Since the grain size is brought in a range which is not excessively smaller or excessively larger than the thickness of the partition wall, the plastic flow of the crystal grain into the small gap is carried out smoothly so that the recesses can be formed with high accuracy.

Further, since the plastic flow is carried out smoothly, crack of a forging punch for forming the recesses, seizure of the material or the like can be prevented. Accordingly, the durability of the forging punch is enhanced considerably while maintaining the molding accuracy.

Preferably, the thickness of the partition wall falls within a range of 20 μm to 50 μm. Here, it is preferable that the grain size is no less than 5 μm and less than 25 μm. In this case, the arrangement density of the pressure generating chamber can be increased while maintaining the smoothness of the plastic flow of the nickel.

Preferably, a Vickers hardness of the nickel is no less than 150 Hv and less than 190 Hv. Since such a hardness is in the soft range for the forging work, it is advantageous for enhancing the durability of the forging punch and ensuring working accuracy.

Preferably, a ductility of the nickel is greater than 5% and less than 20%. This range of ductility is sufficient for forging the recesses. Here, since actual extension of the material produced in the forging work is a small amount relative to the above ductility, plastic recovery force in the respective worked portions can be made as less as possible. This fact is effective to reduce residual stress, so that elastic deformation after the forging can be confined to a harmless range. Accordingly, the accuracy of forming the recesses is enhanced while preventing the chamber formation plate from being bent.

Preferably, a ratio of a height of the partition wall with respect to the thickness of the partition wall falls within a range of 1.0 to 2.1. In this case, such a ration ensures the rigidity of the partition wall, so that the rigidity of the aligned pressure generating chambers can properly be ensured.

Preferably, a ratio of a width of each of the recesses with respect to the thickness of the partition wall falls within a range of 2.0 to 5.0. In this case, since the recess having the sufficient width can be formed relative to the necessary minimum thickness of the partition wall, the predetermined volume of the pressure generating chamber can be ensured. The arrangement density of the pressure generating chambers can be increased while maintaining the required volume of each chamber.

Preferably, a ratio of a depth of each of the recesses with respect to the thickness of the partition wall falls within a range of 2.0 to 4.5. In this case, since the recess having the sufficient volume can be formed relative to the necessary minimum thickness of the partition wall, the predetermined volume of the pressure generating chamber can be ensured while maintaining the rigidity of the partition wall.

It is preferable that: a bottom of each of the recesses has a V-shaped cross section when viewed from a second direction perpendicular to the first direction; and an angle between faces forming the V-shaped cross section falls within a range of 45 degrees to 110 degrees. In this case, the volume of the pressure generating chamber can sufficiently be enlarged at the deepest portion of the bottom. Therefore, the width of the recess can be reduced so that the arrangement density of the pressure generating chamber can be increased.

Preferably, the fixed pitch is 0.3 mm or less. Even in a case where such a minute members are formed by the forging work, desired accuracy can be attained by satisfying the above numeric requirement.

In the above manufacturing method, the material plate may be prepared so as to satisfy the above numeric requirements.

Preferably, the step of providing the material plate includes a step of subjecting row nickel to a rolling work. In this case, the thickness of the material plate can be controlled with high accuracy. Further, since such a rolled material of nickel is subjected to the forging work, the recesses and the partition walls can be formed with high accuracy, while satisfying the above numeric requirements. Further smooth plastic flow is achieved by selecting a direction of a longitudinal direction of the recesses in accordance with a state of nickel formed by the rolling work.

BRIEF DESCRIPTION OF THE DRAWINGS

The above objects and advantages of the present invention will become more apparent by describing in detail preferred exemplary embodiments thereof with reference to the accompanying drawings, wherein:

FIG. 18A is an enlarged view of one projection in the preforming female die;

FIG. 18B is a section view taken along a line B—B in FIG. 18A;

FIG. 18C is a section view taken along a line C—C in FIG. 18A;

FIG. 18D is an enlarged view of a first modified example of the preforming female die;

FIG. 18E is an enlarged view of a second modified example of the preforming female die;

FIG. 18F is an enlarged view of a third modified example of the preforming female die;

FIG. 18G is an enlarged view of a fourth modified example of the preforming female die;

FIG. 18H is an enlarged view of a fifth modified example of the preforming female die;

FIG. 18I is an enlarged view of a sixth modified example of the preforming female die.

DETAILED DESCRIPTION OF THE INVENTION

Embodiments of the invention will be described below with reference to the accompanying drawings. Firstly, the constitution of a liquid ejection head will be described.

Since it is preferable to apply the invention to a recording head of an ink jet recording apparatus, as an example representative of the liquid ejection head, the above recording head is shown in the embodiment.

Figure 1:
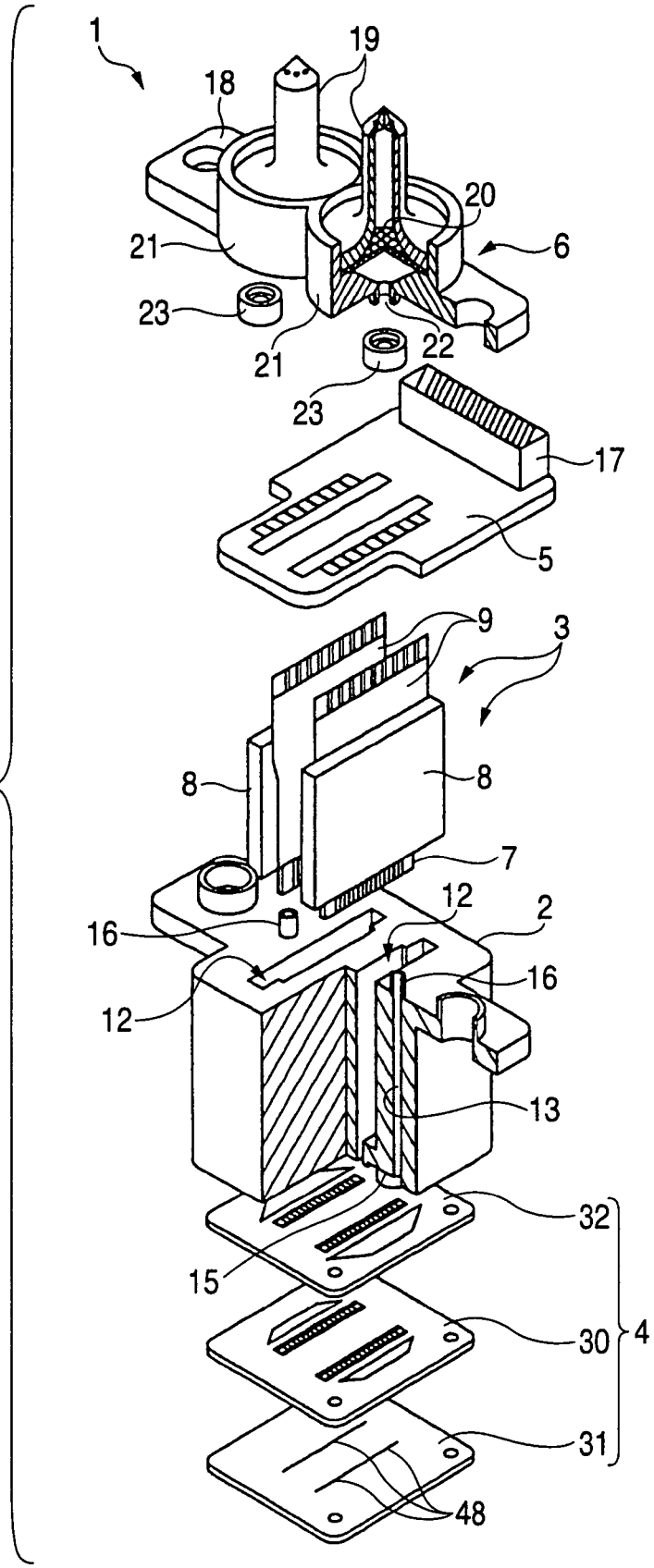
FIG. 1 is a perspective view of a disassembled ink jet recording head according to a first example.
Figure 2:
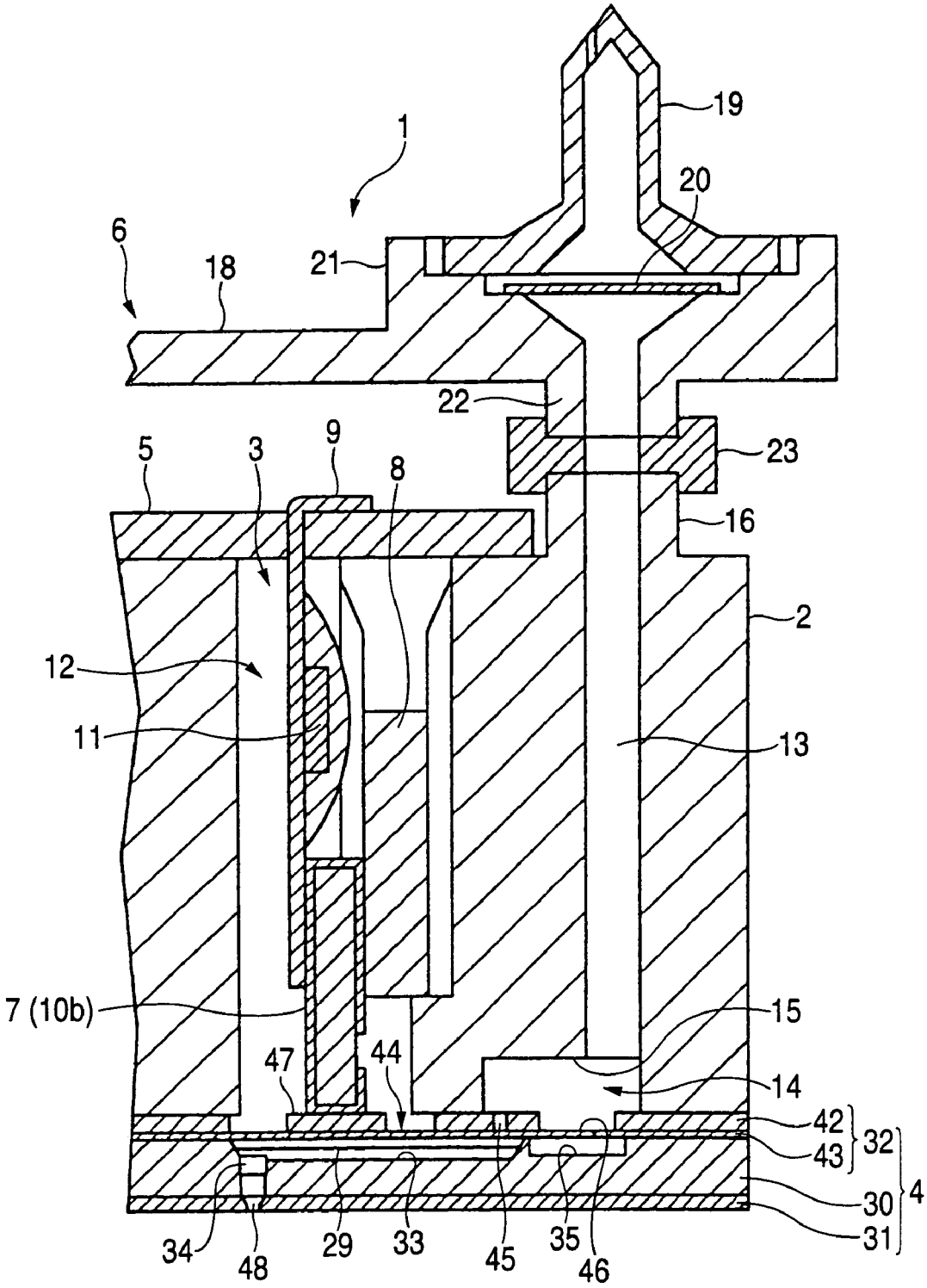
FIG. 2 is a sectional view of the ink jet recording head.

As shown in FIGS. 1 and 2, a recording head 1 is roughly constituted by a casing 2, a vibrator unit 3 contained at inside of the casing 2, a flow path unit 4 bonded to a front end face of the casing 2, a connection board 5 arranged onto a rear end face of the casing 2, a supply needle unit 6 attached to the rear end face of the casing 2.

Figure 3A:
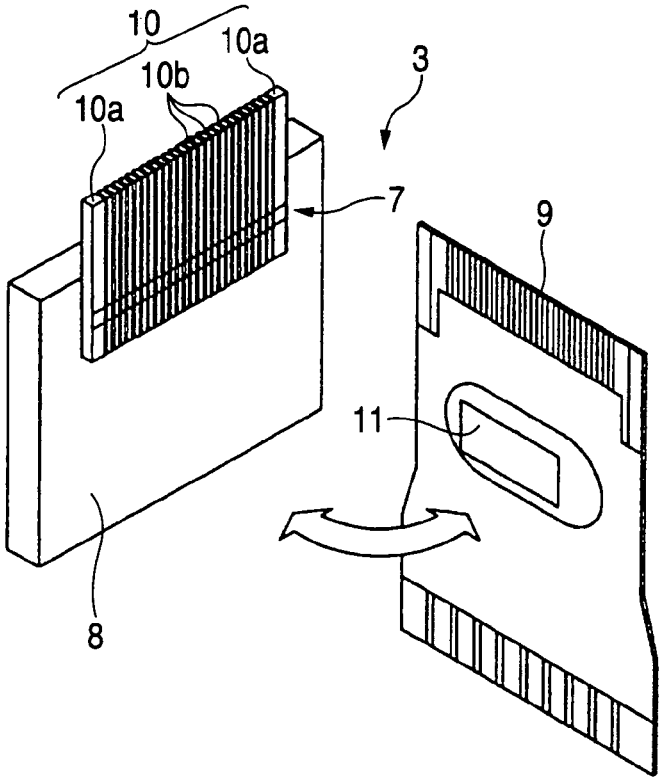
FIGS. 3A and 3B are views for explaining a vibrator unit.
Figure 3B:
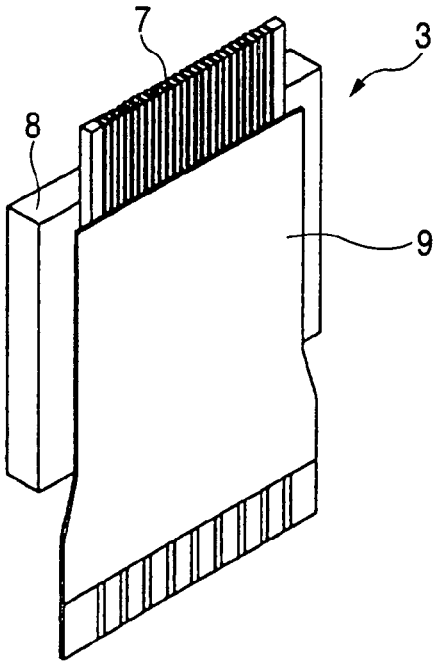

As shown in FIGS. 3A and 3B, the vibrator unit 3 is roughly constituted by a piezoelectric vibrator group 7, a fixation plate 8 bonded with the piezoelectric vibrator group 7 and a flexible cable 9 for supplying a drive signal to the piezoelectric vibrator group 7.

The piezoelectric vibrator group 7 is provided with a plurality of piezoelectric vibrators 10 formed in a shape of a row. The respective piezoelectric vibrators 10 are constituted by a pair of dummy vibrators 10*a* disposed at both ends of the row and a plurality of drive vibrators 10*b* arranged between the dummy vibrators 10*a*. Further, the respective drive vibrators 10*b* are cut to divide in a pectinated shape having an extremely slender width of, for example, about 50 μm through 100 μm, so that 180 pieces are provided.

Further, the dummy vibrator 10*a* is provided with a width sufficiently wider than that of the drive vibrator 10*b* and is provided with a function for protecting the drive vibrator 10*b* against impact or the like and a guiding function for positioning the vibrator unit 3 at a predetermined position.

A free end portion of each of the piezoelectric vibrators 10 is projected to an outer side of a front end face of the fixation plate 8 by bonding a fixed end portion thereof onto the fixation plate 8. That is, each of the piezoelectric vibrators 10 is supported on the fixation plate 8 in a cantilevered manner. Further, the free end portions of the respective piezoelectric vibrators 10 are constituted by alternately laminating piezoelectric bodies and inner electrodes so that extended and contracted in a longitudinal direction of the elements by applying a potential difference between the electrodes opposed to each other.

The flexible cable 9 is electrically connected to the piezoelectric vibrator 10 at a side face of a fixed end portion thereof constituting a side opposed to the fixation plate 8. Further, a surface of the flexible cable 9 is mounted with an IC 11 for controlling to drive the piezoelectric vibrator 10 or the like. Further, the fixation plate 8 for supporting the respective piezoelectric vibrators 10 is a plate-like member having a rigidity capable of receiving reaction force from the piezoelectric vibrators 10, and a metal plate of a stainless steel plate or the like is preferably used therefor.

The casing 2 is a block-like member molded by a thermosetting resin of an epoxy species resin or the like. Here, the casing 2 is molded by the thermosetting resin because the thermosetting resin is provided with a mechanical strength higher than that of a normal resin, a linear expansion coefficient is smaller than that of a normal resin so that deformability depending on the environmental temperature is small. Further, inside of the casing 2 is formed with a container chamber 12 capable of containing the vibrator unit 3, and an ink supply path 13 constituting a portion of a flow path of ink. Further, the front end face of the casing 2 is formed with a recess 15 for constituting a common ink reservoir 14.

The container chamber 12 is a hollow portion having a size of capable of containing the vibrator unit 3. At a portion of a front end side of the container chamber 12, a step portion is formed such that a front end face of the fixation plate 8 is brought into contact therewith.

The recess 15 is formed by partially recessing the front end face of the casing 2 so has to have a substantially trapezoidal shape formed at left and right outer sides of the container chamber 12.

The ink supply path 13 is formed to penetrate the casing 2 in a height direction thereof so that a front end thereof communicates with the recess 15. Further, a rear end portion of the ink supply path 13 is formed at inside of a connecting port 16 projected from the rear end face of the casing 2.

The connection board 5 is a wiring board formed with electric wirings for various signals supplied to the recording head 1 and provided with a connector 17 capable of connecting a signal cable. Further, the connection board 5 is arranged on the rear end face of the casing 2 and connected with electric wirings of the flexible cable 9 by soldering or the like. Further, the connector 17 is inserted with a front end of a signal cable from a control apparatus (not illustrated).

The supply needle unit 6 is a portion connected with an ink cartridge (not illustrated) and is roughly constituted by a needle holder 18, an ink supply needle 19 and a filter 20.

The ink supply needle 19 is a portion inserted into the ink cartridge for introducing ink stored in the ink cartridge. A distal end portion of the ink supply needle 19 is sharpened in a conical shape to facilitate to insert into the ink cartridge. Further, the distal end portion is bored with a plurality of ink introducing holes for communicating inside and outside of the ink supply needle 19. Further, since the recording head according to the embodiment can eject two kinds of inks, two pieces of the ink supply needles 19 are provided.

The needle holder 18 is a member for attaching the ink supply needle 19, and a surface thereof is formed with base seats 21 for two pieces of the ink supply needles 19 for fixedly attaching proximal portions of the ink supply needles 19. The base seat 21 is fabricated in a circular shape in compliance with a shape of a bottom face of the ink supply needle 19. Further, a substantially central portion of the bottom face of the base seat is formed with an ink discharge port 22 penetrated in a plate thickness direction of the needle holder 18. Further, the needle holder 18 is extended with a flange portion in a side direction.

The filter 20 is a member for hampering foreign matters at inside of ink such as dust, burr in dieing and the like from passing therethrough and is constituted by, for example, a metal net having a fine mesh. The filter 20 is adhered to a filter holding groove formed at inside of the base seat 21.

Further, as shown in FIG. 2, the supply needle unit 6 is arranged on the rear end face of the casing 2. In the arranging state, the ink discharge port 22 of the supply needle unit 6 and the connecting port 16 of the casing 2 are communicated with each other in a liquid tight state via a packing 23.

Next, the above-described flow path unit 4 will be explained. The flow path unit 4 is constructed by a constitution in which a nozzle plate 31 is bonded to one face of a chamber formation plate 30 and an elastic plate 32 is bonded to other face of the chamber formation plate 30.

Figure 4:
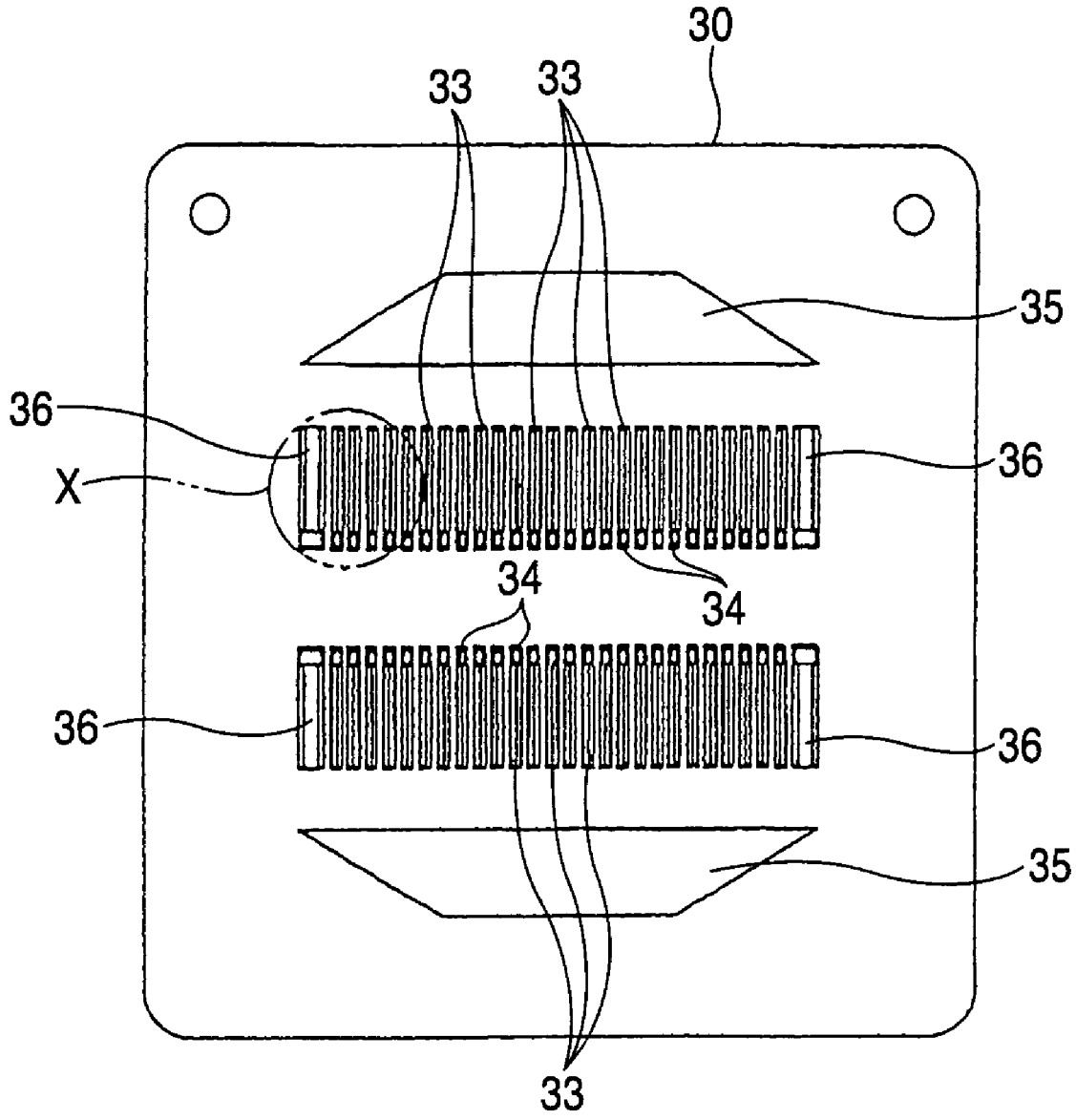
FIG. 4 is a plan view of a chamber formation plate.

As shown in FIG. 4, the chamber formation plate 30 is a plate-like member made of a metal formed with an elongated recess portion 33, a communicating port 34 and an escaping recess portion 35. According to the embodiment, the chamber formation plate 30 is fabricated by working a metal substrate made of nickel having a thickness of 0.35 mm.

An explanation will be given here of reason of selecting nickel of the metal substrate. First reason is that the linear expansion coefficient of nickel is substantially equal to a linear expansion coefficient of a metal (stainless steel in the embodiment as mentioned later) constituting essential portions of the nozzle plate 31 and the elastic plate 32. That is, when the linear expansion coefficients of the chamber formation plate 30, the elastic plate 32 and the nozzle plate 31 constituting the flow path unit 4 are substantially equal, in heating and adhering the respective members, the respective members are uniformly expanded.

Therefore, mechanical stress of warping or the like caused by a difference in the expansion rates is difficult to generate. As a result, even when the adhering temperature is set to high temperature, the respective members can be adhered to each other without trouble. Further, even when the piezoelectric vibrator 10 generates heat in operating the recording head 1 and the flow path unit 4 is heated by the heat, the respective members 30, 31 and 32 constituting the flow path unit 4 are uniformly expanded. Therefore, even when heating accompanied by activating the recording head 1 and cooling accompanied by deactivating are repeatedly carried out, a drawback of exfoliation or the like is difficult to be brought about in the respective members 30, 31 and 32 constituting the flow path unit 4.

Second reason is that nickel is excellent in corrosion resistance. That is, aqueous ink is preferably used in the recording head 1 of this kind, it is important that alteration of rust or the like is not brought about even when the recording head 1 is brought into contact with water over a long time period. In this respect, nickel is excellent in corrosion resistance similar to stainless steel and alteration of rust or the like is difficult to be brought about.

Third reason is that nickel is rich in ductility. That is, in manufacturing the chamber formation plate 30, as mentioned later, the fabrication is carried out by plastic working (for example, forging). Further, the elongated recess portion 33 and the communicating port 34 formed in the chamber formation plate 30 are of extremely small shapes and high dimensional accuracy is requested therefor. When nickel is used for the metal substrate, since nickel is rich in ductility, the elongated recess portion 33 and the communicating port 34 can be formed with high dimensional accuracy even by plastic working.

Further, with regard to the chamber formation plate 30, the chamber formation plate 30 may be constituted by a metal other than nickel when the condition of the linear expansion coefficient, the condition of the corrosion resistance and the condition of the ductility are satisfied.

Figure 5A:
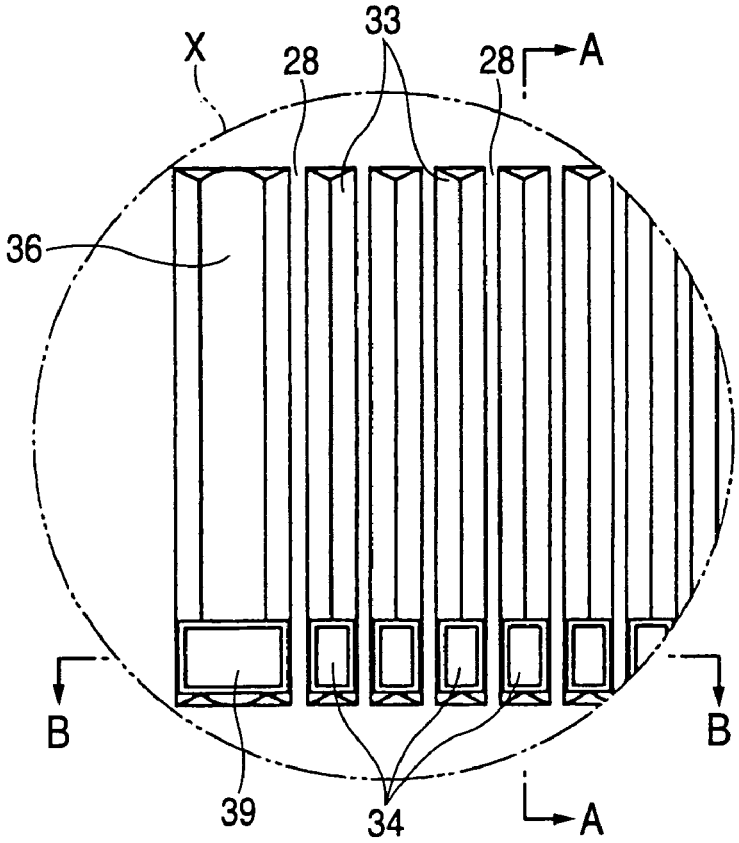
FIG. 5A is a view enlarging an X portion in FIG. 4.
Figure 5B:
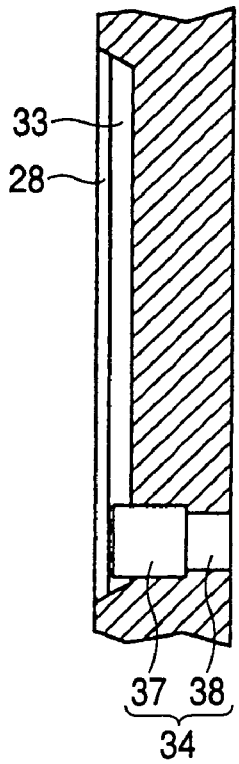
FIG. 5B is a sectional view taken along a line A—A of FIG. 5A.
Figure 5C:
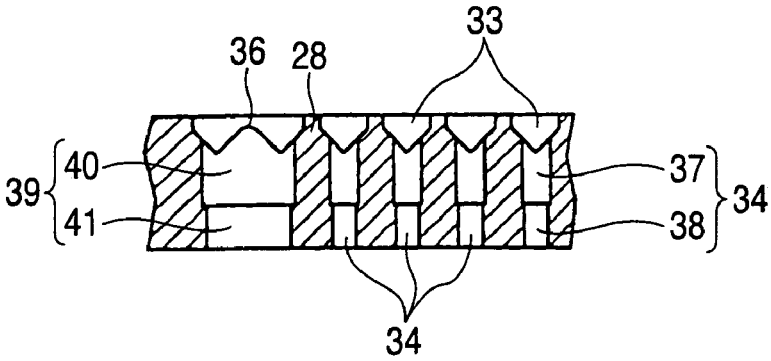
FIG. 5C is a sectional view taken along a line B—B of FIG. 5A.

The elongated recess portion 33 is a recess portion in a groove-like shape constituting a pressure generating chamber 29 and is constituted by a groove in a linear shape as shown to enlarge in FIG. 5A. According to the embodiment, 180 pieces of grooves each having a width of about 0.1 mm, a length of about 1.5 mm and a depth of about 0.1 mm are aligned side by side. A bottom face of the elongated recess portion 33 is recessed in a V-like shape by reducing a width thereof as progressing in a depth direction (that is, depth side). The bottom face is recessed in the V-like shape to increase a rigidity of a partition wall 28 for partitioning the contiguous pressure generating chambers 29. That is, by recessing the bottom face in the V-like shape, a wall thickness of the proximal portion of the partition wall 28 is thickened to increase the rigidity of the partition wall 28. Further, when the rigidity of the partition wall 28 is increased, influence of pressure variation from the contiguous pressure generating chamber 29 is difficult to be effected. That is, a variation of ink pressure from the contiguous pressure generating chamber 29 is difficult to transmit. Further, by recessing the bottom face in the V-like shape, the elongated recess portion 33 can be formed with excellent dimensional accuracy by plastic working (to be mentioned later). Further, an angle between the inner faces of the recess portion 33 is, for example, around 90 degrees although prescribed by a working condition.

Further, since a wall thickness of a distal end portion of the partitioning wall 28 is extremely thin, even when the respective pressure generating chambers 29 are densely formed, a necessary volume can be ensured.

Both longitudinal end portions of the elongated recess portion 33 are sloped downwardly to inner sides as progressing to the depth side. The both end portions are constituted in this way to form the elongated recess portion 33 with excellent dimensional accuracy by plastic working.

Further, contiguous to the elongated recess portion 33 at the both ends of the row, there are formed single ones of dummy recesses 36 having a width wider than that of the elongated recess portion 33. The dummy recess portion 36 is a recess portion in a groove-like shape constituting a dummy pressure generating chamber which is not related to ejection of ink drops. The dummy recess portion 36 according to the embodiment is constituted by a groove having a width of about 0.2 mm, a length of about 1.5 mm and a depth of about 0.1 mm. Further, a bottom face of the dummy recess portion 36 is recessed in a W-like shape. This is also for increasing the rigidity of the partition wall 28 and forming the dummy recess portion 36 with excellent dimensional accuracy by plastic working.

Further, a row of recesses is constituted by the respective elongated recess portions 33 and the pair of dummy recess portions 36. According to the embodiment, two rows of the recesses are formed as shown in FIG. 4.

The communicating port 34 is formed as a small through hole penetrating from one end of the elongated recess portion 33 in a plate thickness direction. The communicating ports 34 are formed for respective ones of the elongated recess portions 33 and are formed by 180 pieces in a single recess portion row. The communicating port 34 of the embodiment is in a rectangular shape in an opening shape thereof and is constituted by a first communicating port 37 formed from a side of the elongated recess portion 33 to a middle in the plate thickness direction in the chamber formation plate 30 and a second communicating port 38 formed from a surface thereof on a side opposed to the elongated recess portion 33 up to a middle in the plate thickness direction.

Further, sectional areas of the first communicating port 37 and the second communicating port 38 differ from each other and an inner dimension of the second communicating port 38 is set to be slightly smaller than an inner dimension of the first communicating port 37. This is caused by manufacturing the communicating port 34 by pressing. The chamber formation plate 30 is fabricated by working a nickel plate having a thickness of 0.35 mm, a length of the communicating port 34 becomes equal to or larger than 0.25 mm even when the depth of the recess portion 33 is subtracted. Further, the width of the communicating port 34 needs to be narrower than the groove width of the elongated recess portion 33, set to be less than 0.1 mm. Therefore, when the communicating port 34 is going to be punched through by a single time of working, a male die (punch) is buckled due to an aspect ratio thereof.

Therefore, in the embodiment, the working is divided into two steps. In the first step, the first communicating port 37 is formed halfway in the plate thickness direction, and in the second step, the second communicating port 38 is formed. The working process of this communicating port 34 will be described later.

Further, the dummy recess portion 36 is formed with a dummy communicating port 39. Similar to the above-described communicating port 34, the dummy communicating port 39 is constituted by a first dummy communicating port 40 and a second dummy communicating port 41 and an inner dimension of the second dummy communicating port 41 is set to be smaller than an inner dimension of the first dummy communicating port 40.

Further, although according to the embodiment, the communicating port 34 and the dummy communicating port 39 opening shapes of which are constituted by small through holes in a rectangular shape are exemplified, the invention is not limited to the shape. For example, the shape may be constituted by a through hole opened in a circular shape or a through hole opened in a polygonal shape.

The escaping recess portion 35 forms an operating space of a compliance portion 46 (described later) in the common ink reservoir 14. According to the embodiment, the escaping recess portion 35 is constituted by a recess portion in a trapezoidal shape having a shape substantially the same as that of the recess 15 of the casing 2 and a depth equal to that of the elongated recess portion 33.

The region where the escaping recess portion 35 is provided may be formed as a through hole to be used as the common ink reservoir. In this case, the common ink reservoir 14 may be omitted from the casing 2 so that the ink supply path 13 and the through hole are communicated.

Next, the above-described elastic plate 32 will be explained. The elastic plate 32 is a kind of a sealing plate of the invention and is fabricated by, for example, a composite material having a two-layer structure laminating an elastic film 43 on a support plate 42. According to the embodiment, a stainless steel plate is used as the support plate 42 and PPS (polyphenylene sulphide) is used as the elastic film 43.

Figure 6:
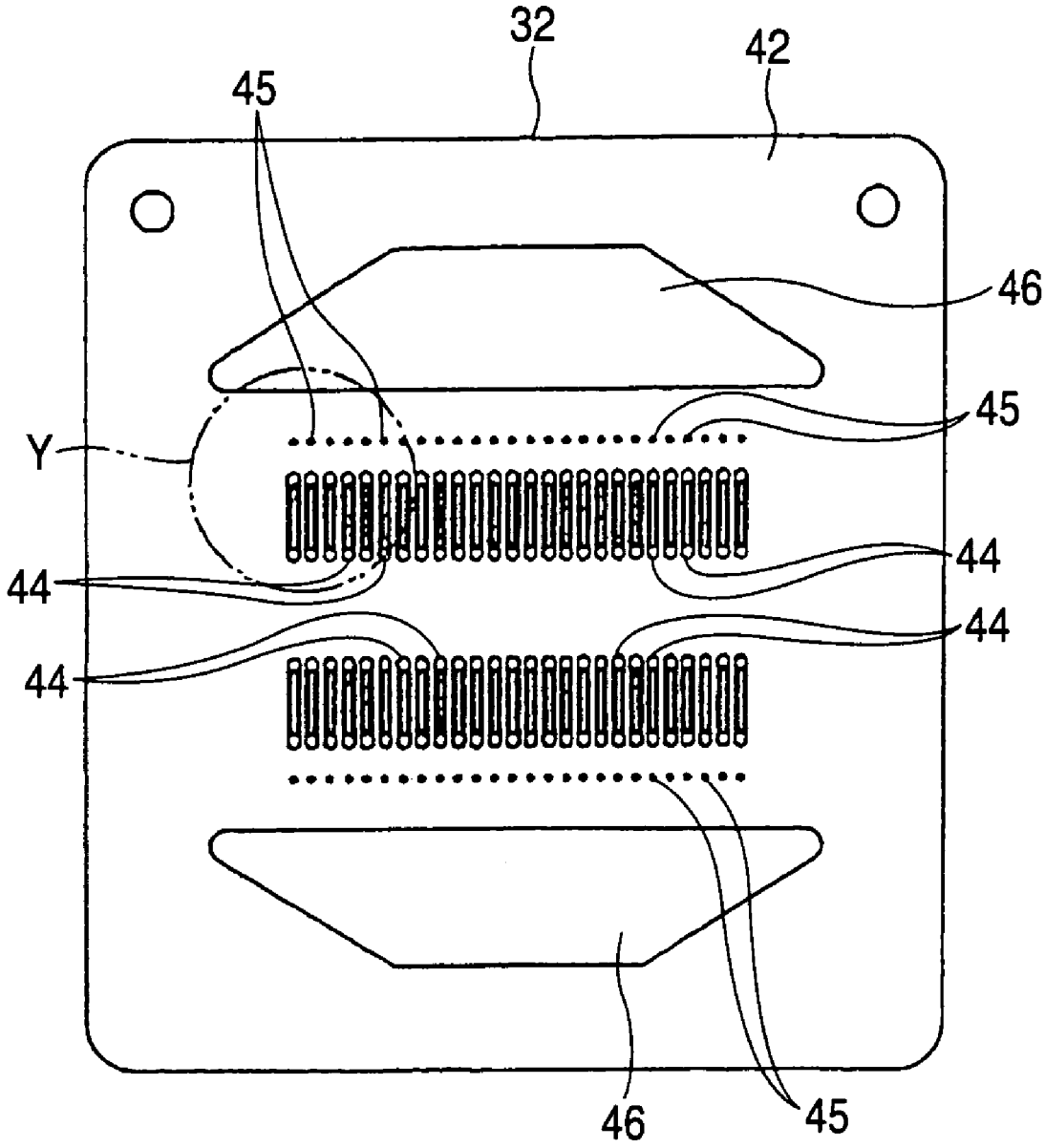
FIG. 6 is a plan view of an elastic plate.

As shown in FIG. 6, the elastic plate 32 is formed with a diaphragm portion 44, an ink supply port 45 and the compliance portion 46.

The diaphragm portion 44 is a portion for partitioning a portion of the pressure generating chamber 29. That is, the diaphragm portion 44 seals an opening face of the elongated recess portion 33 and forms to partition the pressure generating chamber 29 along with the elongated recess portion 33. As shown in FIG. 7A, the diaphragm portion 44 is of a slender shape in correspondence with the elongated recess portion 33 and is formed for each of the elongated recess portions 33 with respect to a sealing region for sealing the elongated recess portion 33. Specifically, a width of the diaphragm portion 44 is set to be substantially equal to the groove width of the elongated recess portion 33 and a length of the diaphragm portion 44 is set to be a slight shorter than the length of the elongated recess portion 33. With regard to the length, the length is set to be about two thirds of the length of the elongated recess portion 33. Further, with regard to a position of forming the diaphragm portion 44, as shown in FIG. 2, one end of the diaphragm portion 44 is aligned to one end of the elongated recess portion 33 (end portion on a side of the communicating port 34).

Figure 7B:
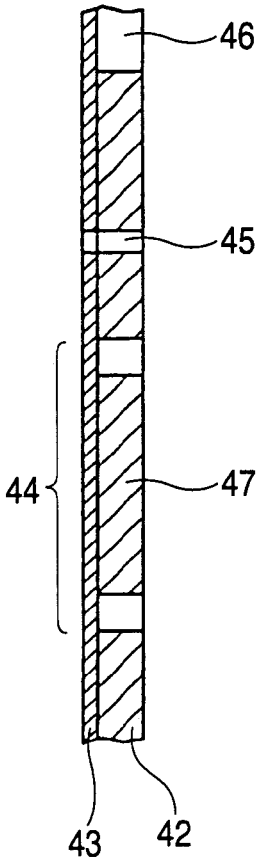
FIG. 7B is a sectional view taken along a line C—C of FIG. 7A.
Figure 7A:
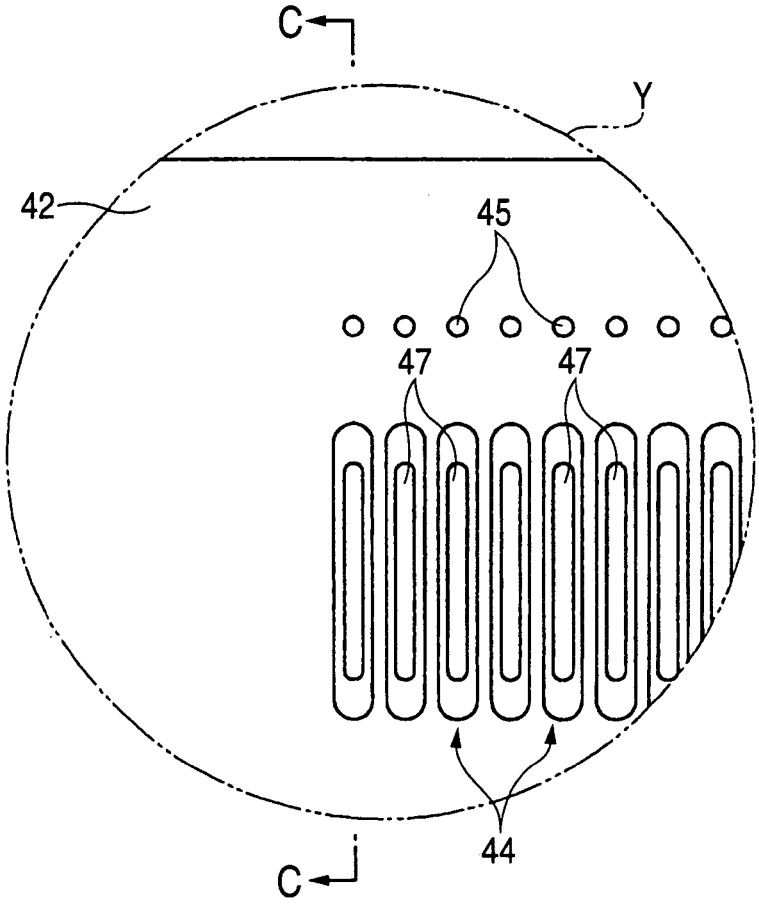
FIG. 7A is a view enlarging a Y portion of FIG. 6.

As shown in FIG. 7B, the diaphragm portion 44 is fabricated by removing the support plate 42 at a portion thereof in correspondence with the elongated recess portion 33 by etching or the like to constitute only the elastic film 43 and an island portion 47 is formed at inside of the ring. The island portion 47 is a portion bonded with a distal end face of the piezoelectric vibrator 10.

The ink supply port 45 is a hole for communicating the pressure generating chamber 29 and the common ink reservoir 14 and is penetrated in a plate thickness direction of the elastic plate 32. Similar to the diaphragm portion 44, also the ink supply port 45 is formed to each of the elongated recess portions 33 at a position in correspondence with the elongated recess portion 33. As shown in FIG. 2, the ink supply port 45 is bored at a position in correspondence with other end of the elongated recess portion 33 on a side opposed to the communicating port 34. Further, a diameter of the ink supply port 45 is set to be sufficiently smaller than the groove width of the elongated recess portion 33. According to the embodiment, the ink supply port 45 is constituted by a small through hole of 23 μm.

Reason of constituting the ink supply port 45 by the small through hole in this way is that flow path resistance is provided between the pressure generating chamber 29 and the common ink reservoir 14. That is, according to the recording head 1, an ink drop is ejected by utilizing a pressure variation applied to ink at inside of the pressure generating chamber 29. Therefore, in order to efficiently eject an ink drop, it is important that ink pressure at inside of the pressure generating chamber 29 is prevented from being escaped to a side of the common ink reservoir 14 as less as possible. From the view point, the ink supply port 45 is constituted by the small through hole.

The ink supply port 45 may be formed with the elastic plate 32 as an elongated hole, or may be formed with the chamber formation plate 30 as a groove.

Further, when the ink supply port 45 is constituted by the through hole as in the embodiment, there is an advantage that the working is facilitated and high dimensional accuracy is achieved. That is, the ink supply port 45 is the through hole, can be fabricated by laser machining. Therefore, even a small diameter can be fabricated with high dimensional accuracy and also the operation is facilitated.

The compliance portion 46 is a portion for partitioning a portion of the common ink reservoir 14. That is, the common ink reservoir 14 is formed to partition by the compliance portion 46 and the recess 15. The compliance portion 46 is of a trapezoidal shape substantially the same as an opening shape of the recess 15 and is fabricated by removing a portion of the support plate 42 by etching or the like to constitute only the elastic film 43.

Further, the support plate 42 and the elastic film 43 constituting the elastic plate 32 are not limited to the example. Further, polyimide may be used as the elastic film 43. Further, the elastic plate 32 may be constituted by a metal plate provided with a thick wall and a thin wall at a surrounding of the thick wall for constituting the diaphragm portion 44 and a thin wall for constituting the compliance portion 46.

Next, the above-described nozzle plate 31 will be explained. The nozzle plate 31 is a plate-like member made of a metal aligned with a plurality of nozzle orifices 48 at a pitch in correspondence with a dot forming density. According to the embodiment, a nozzle row is constituted by aligning a total of 180 pieces of the nozzle orifices 48 and two rows of the nozzles are formed as shown in FIG. 2.

Further, when the nozzle plate 31 is bonded to other face of the chamber formation plate 30, that is, to a surface thereof on a side opposed to the elastic plate 32, the respective nozzle orifices 48 face the corresponding communicating ports 34.

Further, when the above-described elastic plate 32 is bonded to one surface of the chamber formation plate 30, that is, a face thereof for forming the elongated recess portion 33, the diaphragm portion 44 seals the opening face of the elongated recess portion 33 to form to partition the pressure generating chamber 29. Similarly, also the opening face of the dummy recess portion 36 is sealed to form to partition the dummy pressure generating chamber. Further, when the above-described nozzle plate 31 is bonded to other surface of the chamber formation plate 30, the nozzle orifice 48 faces the corresponding communicating port 34. When the piezoelectric vibrator 10 bonded to the island portion 47 is extended or contracted under the state, the elastic film 43 at a surrounding of the island portion is deformed and the island portion 47 is pushed to the side of the elongated recess portion 33 or pulled in a direction of separating from the side of the elongated recess portion 33. By deforming the elastic film 43, the pressure generating chamber 29 is expanded or contracted to provide a pressure variation to ink at inside of the pressure generating chamber 29.

When the elastic plate 32 (that is, the flow path unit 4) is bonded to the casing 2, the compliance portion 46 seals the recess 15. The compliance portion 46 absorbs the pressure variation of ink stored in the common ink reservoir 14. That is, the elastic film 43 is deformed in accordance with pressure of stored ink. Further, the above-described escaping recess portion 35 forms a space for allowing the elastic film 43 to be expanded.

The recording head 1 having the above-described constitution includes a common ink flow path from the ink supply needle 19 to the common ink reservoir 14, and an individual ink flow path reaching each of the nozzle orifices 48 by passing the pressure generating chamber 29 from the common ink reservoir 14. Further, ink stored in the ink cartridge is introduced from the ink supply needle 19 and stored in the common ink reservoir 14 by passing the common ink flow path. Ink stored in the common ink reservoir 14 is ejected from the nozzle orifice 48 by passing the individual ink flow path.

For example, when the piezoelectric vibrator 10 is contracted, the diaphragm portion 44 is pulled to the side of the vibrator unit 3 to expand the pressure generating chamber 29. By the expansion, inside of the pressure generating chamber 29 is brought under negative pressure, ink at inside of the common ink reservoir 14 flows into each pressure generating chamber 29 by passing the ink supply port 45. Thereafter, when the piezoelectric vibrator 10 is extended, the diaphragm portion 44 is pushed to the side of the chamber formation plate 30 to contract the pressure generating chamber 29. By the contraction, ink pressure at inside of the pressure generating chamber 29 rises and an ink drop is ejected from the corresponding nozzle orifice 48.

According to the recording head 1, the bottom face of the pressure generating chamber 29 (elongated recess portion 33) is recessed in the V-like shape. Therefore, the wall thickness of the proximal portion of the partition wall 28 for partitioning the contiguous pressure generating chambers 29 is formed to be thicker than the wall thickness of the distal end portion. Thereby, the rigidity of the thick wall 28 can be increased. Therefore, in ejecting an ink drop, even when a variation of ink pressure is produced at inside of the pressure generating chamber 29, the pressure variation can be made to be difficult to transmit to the contiguous pressure generating chamber 29. As a result, the so-called contiguous cross talk can be prevented and ejection of ink drop can be stabilized.

According to the embodiment, the ink supply port 45 for communicating the common ink reservoir 14 and the pressure generating chamber 29 is constituted by the small hole penetrating the elastic plate 32 in the plate thickness direction, high dimensional accuracy thereof is easily achieved by laser machining or the like. Thereby, an ink flowing characteristic into the respective pressure generating chambers 29 (flowing velocity, flowing amount or the like) can be highly equalized. Further, when the fabrication is carried out by the laser beam, the fabrication is also facilitated.

According to the embodiment, there are provided the dummy pressure generating chambers which are not related to ejection of ink drop contiguously to the pressure generating chambers 29 at end portions of the row (that is, a hollow portion partitioned by the dummy recess portion 36 and the elastic plate 32), with regard to the pressure generating chambers 29 at both ends, one side thereof is formed with the contiguous pressure generating chamber 29 and an opposed thereof is formed with the dummy pressure generating chamber. Thereby, with regard to the pressure generating chambers 29 at end portions of the row, the rigidity of the partition wall partitioning the pressure generating chamber 29 can be made to be equal to the rigidity of the partition wall at the other pressure generating chambers 29 at a middle of the row. As a result, ink drop ejection characteristics of all the pressure generating chambers 29 of the one row can be made to be equal to each other.

With regard to the dummy pressure generating chamber, the width on the side of the aligning direction is made to be wider than the width of the respective pressure generating chambers 29. In other words, the width of the dummy recess portion 36 is made to be wider than the width of the elongated recess portion 33. Thereby, ejection characteristics of the pressure generating chamber 29 at the end portion of the row and the pressure generating chamber 29 at the middle of the row can be made to be equal to each other with high accuracy.

According to the embodiment, the recess 15 is formed by partially recessing the front end face of the casing 2, the common ink reservoir 14 is formed to partition by the recess 15 and the elastic plate 32, an exclusive member for forming the common ink reservoir 14 is dispensed with and simplification of the constitution is achieved. Further, the casing 2 is fabricated by resin dieing, fabrication of the recess 15 is also relatively facilitated.

Next, a method of manufacturing the recording head 1 will be explained. Since the manufacturing method is characterized in steps of manufacturing the chamber formation plate 30, an explanation will be mainly given for the steps of manufacturing the chamber formation plate 30.

The chamber formation plate 30 is fabricated by forging by a progressive die. Further, a metal strip 55 (referred to as "strip 55" in the following explanation) used as a material of the chamber formation plate 30 is made of nickel as described above.

The steps of manufacturing the chamber formation plate 30 comprises steps of forming the elongated recess portion 33 and steps of forming the communicating port 34 which are carried out by a progressive die.

Figure 8A:
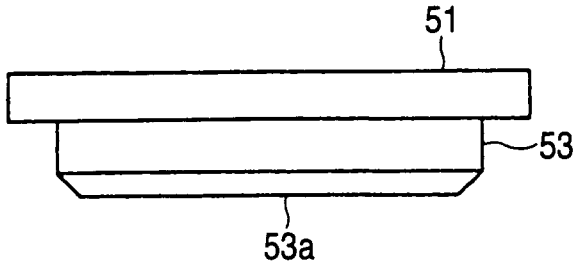
FIGS. 8A and 8B are views for explaining a first male die used in forming elongated recess portions.
Figure 8B:
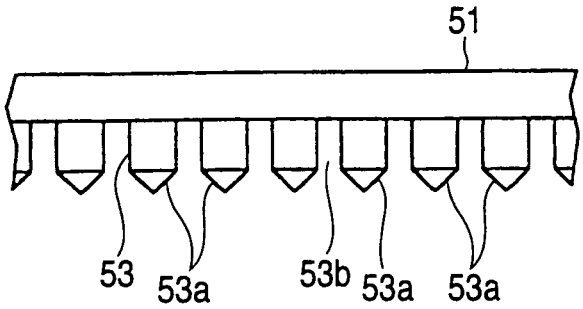
Figure 9A:
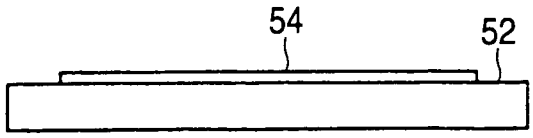
FIGS. 9A and 9B are views for explaining a female die used in forming the elongated recess portions.
Figure 9B:
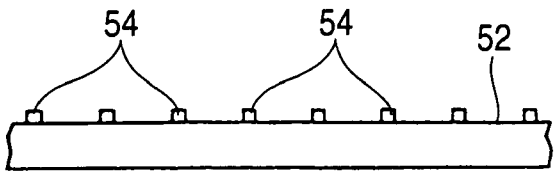

In the elongated recess portion forming steps, a first male die 51 shown in FIGS. 8A and 8B and a female die shown in FIGS. 9A and 9B are used. The first male die 51 is a die for forming the elongated recess portion 33. The male die is aligned with projections 53 for forming the elongated recess portions 33 by a number the same as that of the elongated recess portions 33. Further, the projections 53 at both ends in an aligned direction are also provided with dummy projections (not illustrated) for forming the dummy recess portions 36. A distal end portion 53*a* of the projection 53 is tapered from a center thereof in a width direction by an angle of about 45 degrees as shown in FIG. 8B. Thereby, the distal end portion 53*a* is sharpened in the V-like shape in view from a longitudinal direction thereof. Further, both longitudinal ends of the distal end portions 53A are tapered by an angle of about 45 degrees as shown in FIG. 8A. Therefore, the distal end portion 53*a* of the projection 53 is formed in a shape of tapering both ends of a triangular prism.

Further, the female die 52 is formed with a plurality of projections 54 at an upper face thereof. The projection 54 is for assisting to form the partition wall partitioning the contiguous pressure generating chambers 29 and is disposed between the elongated recess portions 33. The projection 54 is of a quadrangular prism, a width thereof is set to be a slight narrower than an interval between the contiguous pressure generating chambers 29 (thickness of partition wall) and a height thereof is set to a degree the same as that of the width. A length of the projection 54 is set to a degree the same as that of a length of the elongated recess portion 33 (projection 53).

Figure 10A:
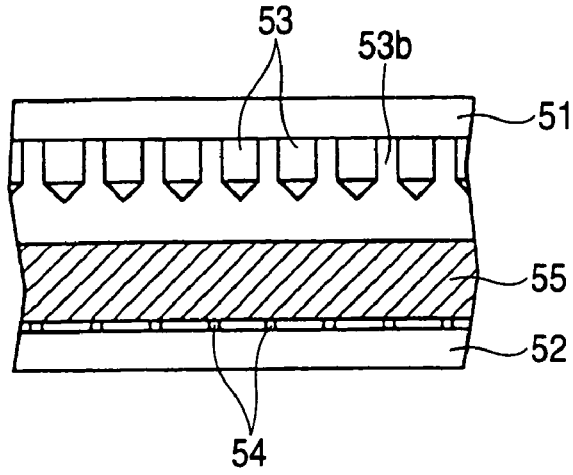
FIGS. 10A to 10C are views for explaining a step of forming the elongated recess portions.
Figure 10B:
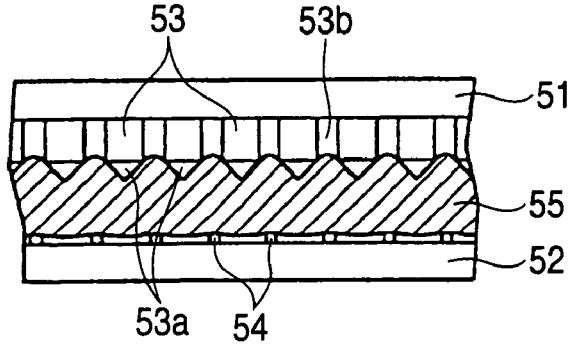
Figure 10C:
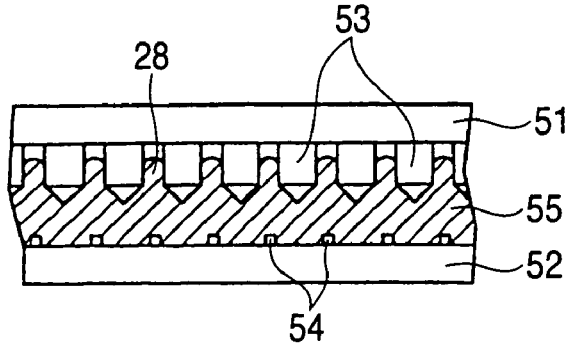

In the elongated recess portion forming steps, first, as shown in FIG. 10A, the strip 55 is mounted at an upper face of the female die 52 and the first male die 51 is arranged on an upper side of the strip 55. Next, as shown in FIG. 10B, the first male die 51 is moved down to push the distal end portion of the projection 53 into the strip 55. At this occasion, since the distal end portion 53*a* of the projection 53 is sharpened in the V-like shape, the distal end portion 53*a* can firmly be pushed into the strip 55 without buckling. Pushing of the projection 53 is carried out up to a middle in a plate thickness direction of the strip 55 as shown in FIG. 10C.

By pushing the projection 53, a portion of the strip 55 flows to form the elongated recess portion 33. In this case, since the distal end portion 53*a* of the projection 53 is sharpened in the V-like shape, even the elongated recess portion 33 having a small shape can be formed with high dimensional accuracy. That is, the portion of the strip 55 pushed by the distal end portion 53*a* flows smoothly, the elongated recess portion 33 to be formed is formed in a shape following the shape of the projection 53. Further, since the both longitudinal ends of the distal end portion 53*a* are tapered, the strip 55 pushed by the portions also flows smoothly. Therefore, also the both end portions in the longitudinal direction of the elongated recess portion 33 are formed with high dimensional accuracy.

Since pushing of the projection 53 is stopped at the middle of the plate thickness direction, the strip 55 thicker than in the case of forming a through hole can be used. Thereby, the rigidity of the chamber formation plate 30 can be increased and improvement of an ink ejection characteristic is achieved. Further, the chamber formation plate 30 is easily dealt with and the operation is advantageous also in enhancing plane accuracy.

A portion of the strip 55 is raised into a space (i.e., the gap 53*b*) between the contiguous projections 53 by being pressed by the projections 53. In this case, the projection 54 provided at the female die 52 is arranged at a position in correspondence with an interval between the projections 53, flow of the strip 55 into the space is assisted. Thereby, the strip 55 can efficiently be introduced into the space between the projections 53 and the protrusion (i.e., the partition wall 28) can be formed highly.

When the elongated recess portions 33 have been formed in this way, the operation proceeds to the stage to form the communicating port 34 which is the minute hole.

Figure 11A:
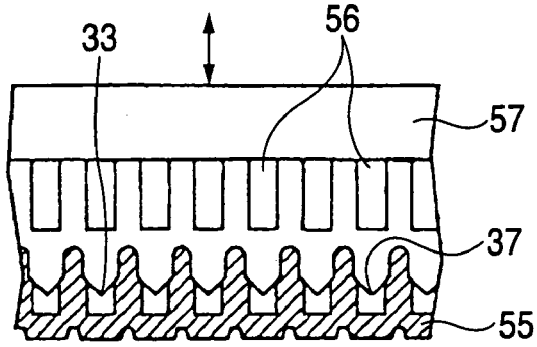
FIG. 11A is a view for explaining a second male die used in forming first communicating ports.
Figure 11B:
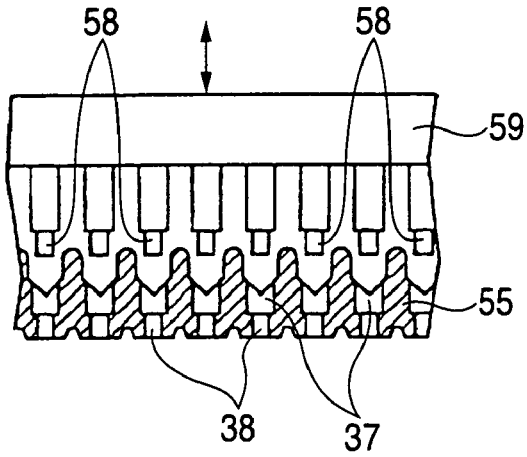
FIG. 11B is a view for explaining a third male die used in forming second communicating ports.

As shown in FIGS. 11A and 11B, in this stage, a second male die 64 and a third male die 59 are used. In the second male die 64, a plurality of pectinated first punches 56 in a shape of a prism in correspondence with the shape of the first communicating port 37 are aligned on a base member at a predetermined pitch. In the third male die 59, a plurality of pectinated second punches 58 in a shape of a prism in correspondence with the shape of the second communicating port 38 are aligned on a base member at a predetermined pitch. Further, the second punches 58 are somewhat thinner than the first punches 56.

First, as shown in FIG. 11A, the first punches 56 of the second male die 64 are pushed up to a middle in a plate thickness direction from a surface of the strip 55 from a side of the elongated recess portions 33 to thereby form unpenetrated recess portions to be the first communicating ports 37. Next, as shown in FIG. 11B, the second punches 58 of the third male die 59 is pushed from the same side to punch through bottom portions of the first communicating ports 37 to thereby form the second communicating ports 38 which are through holes.

In this way, since the communicating port 34 is fabricated by working at a plurality of times by using the punches 56, 58 having different thicknesses, even the extremely small communicating port 34 can be fabricated with excellent dimensional accuracy. Further, since the first communicating port 37 fabricated from the side of the elongated recess portion 33 is formed only up to the middle in the plate thickness direction, it is prevented a drawback that the partition wall 28 or the like of the pressure generating chamber 29 is excessively pulled downward. Thereby, the communicating port 34 can be fabricated with excellent dimensional accuracy without deteriorating the shape of the partition wall 28.

Although steps of fabricating the communicating ports 34 by two times of working are exemplified, the communicating ports 34 may be fabricated by working of three times or more. Further, when the above-described drawback is not brought about, the communicating port 34 may be fabricated by a single working.

Figure 11C:
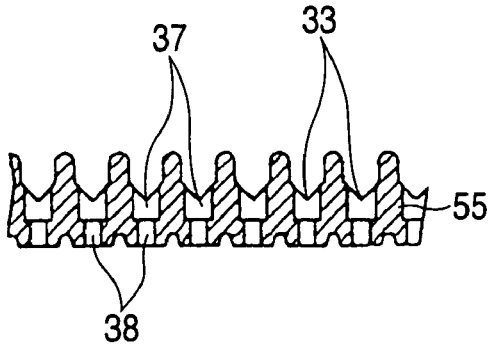
FIG. 11C is a view showing the chamber formation plate in a state before a polishing step is performed.

After the communicating ports 34 are fabricated, both surfaces of the strip 55 are polished to flatten along the chain lines shown in FIG. 11C, so that the plate thickness is adjusted to a predetermined thickness (0.3 mm, in the embodiment).

The step of forming the elongated recess portions and the step of forming the communicating ports may be carried out by separate stages or carried out by the same stage. In a case where the steps are carried out by the same stage, since the strip 55 remains unmoved at both stages, the communicating port 34 can be fabricated in the elongated recess portion 33 with excellent positional accuracy. Both the steps may be carried out in a continuous progressive manner, or may be carried out separately.

After the chamber formation plate 30 is fabricated by the above-described steps, the flow path unit 4 is fabricated by bonding the elastic plate 32 and the nozzle plate 71 which are fabricated separately. In the embodiment, bonding of the respective members is carried out by adhering. Since the both surfaces of the chamber formation plate 30 are flattened by the above-described polishing, the elastic plate 32 and the nozzle plate 31 can firmly be adhered thereto.

Since the elastic plate 32 is the composite material constituting the support plate 42 by the stainless steel plate, the linear expansion rate is prescribed by stainless steel constituting the support plate 42. The nozzle plate 31 is also fabricated by the stainless steel plate. As described above, the linear expansion rate of nickel constituting the chamber formation plate 30 is substantially equal to that of stainless steel. Therefore, even when adhering temperature is elevated, warping caused by the difference between the linear expansion rates is not brought about. As a result, the adhering temperature can be set higher than a case where a silicon substrate is used, so that adhering time can be shortened and fabrication efficiency is promoted.

After the flow path unit 4 is fabricated, the vibrator unit 3 and the flow path unit 4 are bonded to the case 2 fabricated separately. Also in this case, bonding of the respective members is carried out by adhering. Therefore, even when the adhering temperature is elevated, warping is not brought about in the flow path unit 4, so that adhering time is shortened.

After the vibrator unit 3 and the flow path unit 4 are bonded to the case 2, the flexible cable 9 of the vibrator unit 3 and the connection board 5 are soldered, thereafter, the supply needle unit 6 is attached thereto to thereby provide the liquid ejection head.

The above plastic working is performed on the strip (material) 55 by the male die 51 and the female die 52 under condition of room temperature, and plastic working described below is performed similarly under condition of room temperature.

The recording head 1 is finished as described above and what is particularly carefully fabricated is the chamber formation plate 30. In the chamber formation plate 30, elongated recess portions 33 for constituting pressure generating chambers 29 aligned side by side are obtained by a forging work while being defined by partition walls 28. Although these members are extremely minute, desired shape or dimensional accuracy must be secured. To this end, it is necessary to find the parameter values best for forming the elongated recess portions 33 from among parameters of metallic material constituting the chamber formation plate 30, in order to carry out more improved forging work.

Figure 12A:
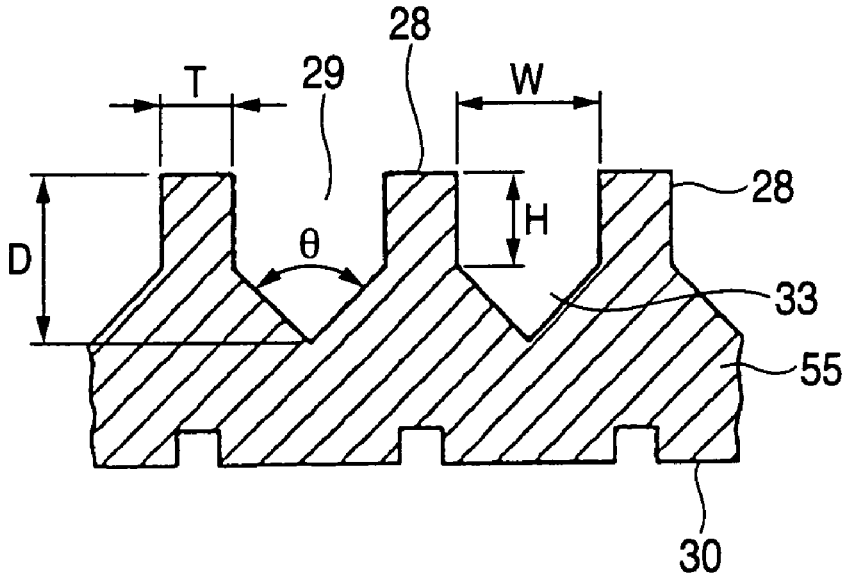
FIG. 12A is an enlarged section view of the chamber formation plate in a state before the first and second communicating ports are formed.
Figure 12B:
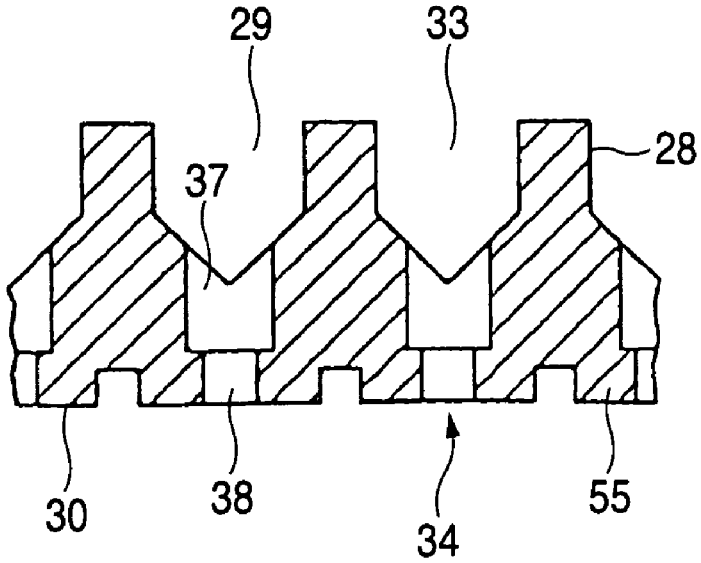
FIG. 12B is an enlarged section view of the chamber formation plate in a state after the first and second communicating ports are formed.

FIG. 12A is a sectional view showing a portion of the chamber formation plate 30 formed by the steps shown in FIGS. 10A to 10C, and a polishing work has been performed (cf., FIG. 11C). FIG. 12B is a sectional view showing a portion of the chamber formation plate 30 formed by the steps shown in FIGS. 11A to 11C. Regarding the thickness of the partition wall 28, in FIGS. 12A and 12B, the thickness is illustrated to be considerably thick to facilitate to understand.

As described above, the chamber formation plate 30 is fabricated by forging the strip made of nickel, the thickness of the strip 55 is 0.35 mm produced by a rolling step. As shown by FIG. 8B and FIG. 10A, the first male die 51 is provided with the gaps 53*b* for forming the partition walls 28 between the respective projections 53. A width of the gap 53*b* is substantially the same as the thickness of the wall of the partition wall 28 and is set to 31 μm in this case. Further, a grain size of a crystal grain of nickel is set to 15 μm in order that the material 55 can carry out plastic flow at inside of the gap 53*b* in a smoother state. The grain size of 15 μm corresponds to about 50% of the thickness of the wall of the partition wall of 31 μm.

Further, hardness of nickel-made material 55 is Hv170 in Vickers hardness with 10% of ductility.

By setting the grain size of the crystal grain to 60% or less of the thickness of the wall (in this example, 50%), the grain size of the crystal grain becomes smaller than the width of the gap 53*b*. Since the grain size is brought in a region which is not excessively smaller or excessively larger than the thickness of the wall, flow of the crystal grain into the small gap 53*b* is smoothly carried out and the elongated recess portion 33 can be formed excellently. Therefore, crack of the forging punch 51 for forming the elongated recess portion 33, seizure of the material or the like is prevented, durability thereof is considerably promoted and formability of the small shape portion is improved.

Further, a number of pieces of aligning the crystal grains in view from the thickness direction of the wall is two pieces or more at most and at least less than two pieces. Since a number of pieces of the crystal grains is not abnormally large, plastic flow into the gap 53*b* is smoothly carried out.

When the aligning piece number of the crystal grains is excessively large, by an increase in the crystal grains relative to the thickness of the wall, grain boundaries are increased in the partition wall 28 and therefore, plastic deformation performance (motion of dislocation) into the gap 53*b* is deteriorated. Accordingly, there is an anxiety that the plastic working of the small partition wall 28 and the elongated recess portion 33 having a predetermined shape and a predetermined dimension is difficult to carry out.

To the contrary, when the aligning piece number of the crystal grain is excessively small, although plastic flow is smoothly carried out, since the size of the crystal grain is relatively large for the partition wall 28, strength of the nickel material is accordingly deteriorated, the small partition wall 28 is further difficult to work with high accuracy.

In the embodiment, by selecting the grain size of the nickel crystal grain to 60% or less of the thickness of the partition wall 28, excellent plastic flow is achieved as described above and the elongated recess portion 33 having the predetermined shape accuracy and dimensional accuracy can be formed.

Since the Vickers hardness is set to Hv170 for nickel, which is set to a value in a soft range suitable for plastic flow, forming of the small elongated recess portion 33 can surely carried out. Further, the hardness is advantageous for enhancing durability and ensuring working accuracy of the forging punch 51 (the projection 53, the front end portion 53*a* and the like). On the other hand, the rigidity of the chamber formation plate 30, to which the forging work has been performed, can be secured so that the cross-talk phenomenon can be prevented to realize stable ejection performance of the ink ejection head. Further, since the material rigidity during or after the forging work can be secured, excessive care for handing the chamber formation plate 30 during the forging process or the assembling process is not necessary.

Since the ductility of nickel is set to 10%, ductility of the material 55 necessary for forging the elongated recess portion 33 is sufficiently ensured, so that plastic flow can sufficiently be carried out. Here, since actual extension of the material 55 produced in forging is a small amount relative to the above ductility, plastic recovery force in the respective worked portions can be made as less as possible. The above-described fact is effective to reduce residual stress, so that elastic deformation after the forging can be confined to a harmless range. Accordingly, the accuracy of forming the elongated recess portion 33 is enhanced while preventing the chamber formation plate 30 from being bent.

A tensile strength of the nickel material is preferably within a range from 400 N/mm$^2$ to 600 N/mm$^2$, more preferably, 450 N/mm$^2$ to 550 N/mm$^2$. So setting of the tensile strength value will accrue to many advantages. A first advantage is that a satisfactory amount of deformation of the material 55, which is necessary for the forging of the elongated recess portions 33, is secured. Satisfactory plastic flow assists the formation of the partition walls 28 is performed. Since the rigidity of the chamber formation plate 30, to which the forging work has been performed, can be secured so that the cross-talk phenomenon can be prevented to realize stable ejection performance of the ink ejection head. Further, since the material rigidity during or after the forging work can be secured, excessive care for handing the chamber formation plate 30 during the forging process or the assembling process is not necessary.

The nickel material in this embodiment contains 99% by weight of nickel. Examples of chemical compositions of the nickel material are listed below (unit: percent by weight).

Ni: 99.9 or more
C: 0.03 or less
Si: 0.01 or less
Mn: 0.035 or less
P: 0.0030 or less
S: 0.0030 or less
Cr: 0.005 or less
Mo: 0.05 or less
Cu: 0.05 or less
O: 0.0030 or less Table 1 shows evaluation results of the grain size of the crystal, the hardness, the ductility of nickel when the chamber formation plate shown in FIGS. 12A and 12B is formed. The thickness T of the partition wall 28 in this case is 31 μm.

As is known from Table 1, somewhat good results are obtained when the grain size of the nickel crystal relative to the thickness of the partition wall 28 is less than 80% (grain size is less than 25 μm). Good results are obtained when the ratio is 60% or less (18 μm or less). More preferable range of the ratio is 60% or less and no less than 15% (5 to 18 μm). Excellent results are obtained when the ratio is less than 50% and no less than 15% (5 to 15 μm). The most excellent result is obtain when the ration is less than 30% and no less than 15% (5 to 10 μm).

TABLE 1

| Evaluated items | Evaluated values | Results |
|---|---|---|
| Grain size of crystal (μm) | 10–15 | excellent |
| | 15–18 | good |
| | 18–25 | fair |
| | 25 or more | no good |
| Hardness (Hv) | 150 | fair |
| | 150–160 | good |
| | 160–180 | excellent |
| | 180–190 | good |
| | 190 or more | no good |
| Ductility (%) | 5 or less | no good |
| | 5–10 | good |
| | 10–20 | excellent |
| | 20–30 | fair |
| | 30 or more | no good |

Regarding the hardness, good results are obtained when the Vickers hardness is no less than 150 Hv and less than 190 Hv. Excellent result is obtained when the Vickers hardness is no less than 160 Hv and less than 180 Hv.

Regarding the ductility, good results are obtained when the value is greater than 5% and less than 20%. Excellent result is obtained when the value is no less than 10% and less than 20%.

Since the nickel-made material 55 has been subjected to a rolling work, the thickness of the material plate 55 produced can be controlled with high accuracy. Further, since such a rolled material of nickel is subjected to a forging work, the groove recess portions 33 and the partition walls 28 can be formed with high accuracy, while satisfying the above numeric requirements. Further smooth plastic flow is achieved by selecting a direction of a longitudinal direction of the elongated recess portions 33 or the like in accordance with a state of nickel formed by the rolling work.

When the thickness T of the partition wall 28 is increased, the rigidity thereof can be ensured and cross talk can be prevented, however, an arrangement density of the pressure generating chambers 29 is reduced to the contrary. When an attempt is made to obtain a predetermined aligning number of the pressure generating chambers 29 while maintaining the large thickness T, the width of the pressure generating chamber 29 is narrowed, so that the volume necessary for the pressure generating chamber 29 cannot be ensured. In such a case, a volume of delivering ink becomes insufficient.

Therefore, dimensions of respective portions need to optimize. A ratio HIT of the height of H (=45 μm) of the partition wall 28 to the thickness of T (=31 μm) of the partition wall 28 is 1.5, the ratio of the height H of the partition wall 28 to a degree of not reducing the rigidity of the partition wall 28 can be ensured, so that the rigidity of the aligned elongated recess portions 33 can properly be ensured. When the above-described ratio falls in a range of 1.0 through 2.1, the rigidity of the partition wall 28 can excellent be maintained, however, the ratio is preferably in a range of 1.2 through 1.8 and is the best in 1.5, as mentioned above.

A ratio W/T of the width of W (=0.11 mm) of the elongated recess portion 33 to the thickness of T (=31 μm) of the partition wall 28 is 3.5, the elongated recess portion having the sufficient width can be formed relative to the necessary minimum thickness of T of the partition wall 28, so that the predetermined volume of the elongated recess portion can be ensured. The elongated recess portions can be aligned in the densest state, and the number of aligning the elongated recess portions per unit length can be made to be as large as possible. Although when the above-described ratio falls in a range of 2.0 though 5.0, the number of aligning the elongated recess portions can excellently be provided, the ratio is preferably in a range of 2.9 through 4.5 and is the best in 3.5, as mentioned above.

A ratio D/T of the thickness of D (=0.1 mm) of the elongated recess portion 33 to the thickness of T (=31 μm) of the partition wall 28 is 3.2, the elongated recess portion 33 having the sufficient depth D can be formed relative to the necessary minimum thickness T of the wall of the partition wall 28, so that the predetermined volume of the elongated recess portion 33 can be ensured while the partition wall 28 can be provided with sufficient rigidity. When the above-described ratio falls in a range of 2.0 through 4.5, the volume of the elongated recess portion 33 can excellently be provided, however, the ratio is preferably in a range of 2.7 through 4.0 and is the best in 3.2, as mentioned above.

The bottom face of the elongated recess portion 33 is formed with a V-shaped cross section with regard to the widthwise direction, so that a central portion thereof constitutes the deepest portion. An inner angle θ of the V-shaped portion is 90 degrees. By being able to enlarge the volume in the depth direction in this way, the width of the elongated recess portion 33 can be reduced and the elongated recess portions 33 can be aligned by a number as large as possible. Although when the above-described inner angle θ falls in a range of 45 through 110 degrees, the volume of the elongated recess portion 33 can be provided excellently, the inner angle θ is preferably in a range of 72 through 100 degrees and is the best in 90 degrees, as mentioned above.

A pitch dimension of the elongated recess portions 33 is 0.14 mm. Even such minute portions to be the pressure generating chambers 29 of the liquid ejection head can be formed with high accuracy, by selecting the above-described numerical value (for example, a ratio of the grain size of the crystal relative to the partition wall thickness is 60% or less. By making the above-described pitch dimension to be 0.3 mm or less, in forming a part of the liquid ejection head or the like, the part is finished excellently. Preferably, the pitch dimension is 0.2 mm or less and is the best in 0.14 mm, as mentioned above.

With respect to the thus prepared nickel plate in which the above numeric requirements (the grain size, the hardness, the ductility, etc.) are satisfied, the punching work for forming the communicating holes 34 is performed as shown in FIGS. 11A to 11C. FIG. 12B shows a state that the communicating holes 34 have been punched. Since an amount of the material punched through while being subjected plastic flow is small, an amount of the crystal grain boundaries included in the punched portion becomes relatively small. Therefore, the communicating ports can easily be punched. On the other hand, since the particle size of the crystal grain is made to be relatively large with respect to the size of the punched communicating port, the strength of the material becomes a value pertinent for punching.

In the case of FIG. 12B, the thickness of the partition wall 28 and the inner diameter dimension of the communicating port 34 are substantially the same, the amount of the grain boundaries included in the punched material is small. Therefore, a load acting on the first punch 56 and the second punch 58 is reduced, which is effective in enhancing durability of the male die.

The nickel material as mentioned above may be prepared in the following manner, for example.

Figure 13:
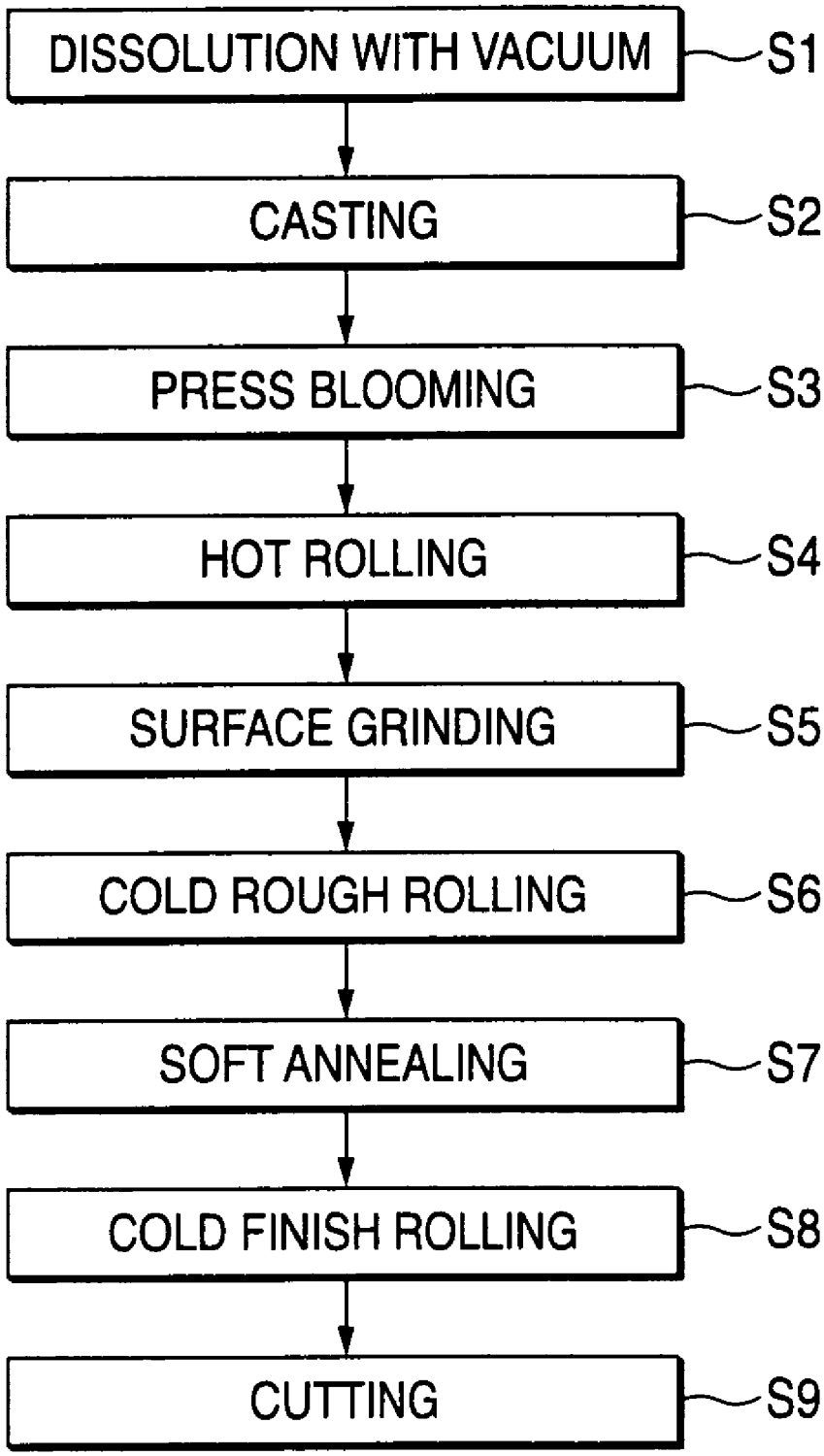
FIG. 13 is a flow chart for explaining steps for preparing a nickel material plate.

As shown in FIG. 13, raw nickel is first dissolved in a vacuum melting furnace (step S1), and is cast into an ingot while being degassed as required (step S2). The ingot is bloomed, by pressing, into a ingot block having an appropriate size (step S3). The resultant is hot rolled to form a plate member having a predetermined thickness (step S4). The surface of the plate member is ground to arrange the condition in a desired state (step S5). The strip is then subjected to a cold rough rolling to be more thinned (step S6). Further, it is subjected to a softening annealing and a stress accumulated therein is removed by a cold rough rolling, whereby it is softened and is adjusted in its crystal grain size (step S7). And, it is subjected to a final cold finishing rolling, whereby a final finishing thickness adjustment is performed (step S8), and is cut in the rolling direction to form elongated strips as a final product (step S9).

The conditions of the softening annealing are: temperature is within a range from 400° C. to 850° C.; and time is within range from several minutes to several tens minutes. If the softening annealing temperature is too low or the softening annealing time is too short, the softening of the object will be insufficient, and a material having the mechanical characteristics (viz., hardness, tensile strength, elongation, etc. which are within the predetermined numeric ranges) cannot be obtained. If the softening annealing temperature is too high or the softening annealing time is too long, the crystal grains grow too much, so that a desired crystal grain size cannot be obtained. In view of such, the softening annealing temperature is within a range from 550° C. to 850° C., preferably, 600° C. to 800° C., more preferably 650° C. to 750° C. The softening annealing time is preferably several minute to several tens minutes.

Figure 14A:
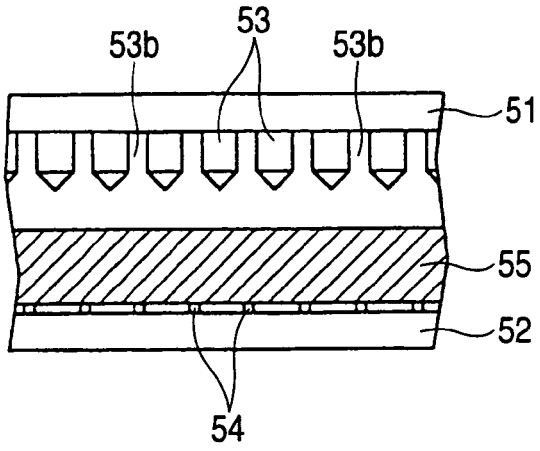
FIGS. 14A to 14C are views for explaining a first modified example of the step of forming the elongated recess portions.
Figure 14B:
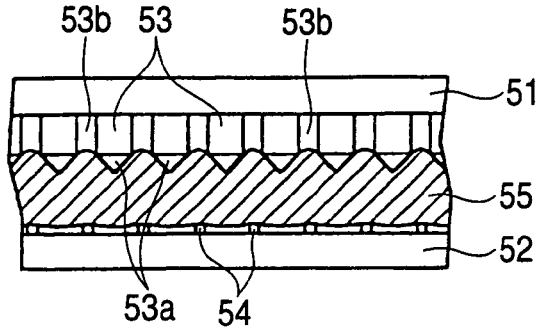
Figure 14C:
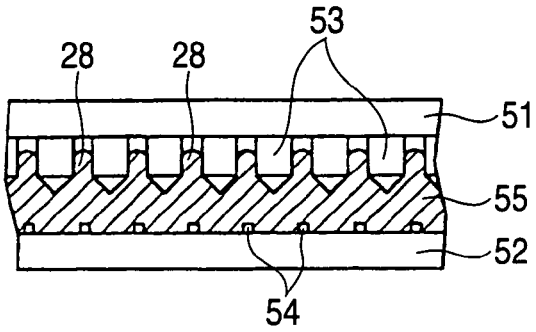

FIGS. 14 to 14C show a first modified example of the step of forming the elongated recess portions.

In this case, although the male die 51 as shown in FIGS. 8A and 8B and the female die 52 as shown in FIGS. 9A and 9B are used as in the above embodiment, the projections 54 of the female die 52 are laterally shifted by a half of the aligning pitch of the pressure generating chambers 29.

Specifically, the projections 53 and the projections 54 are opposed to each other. When the material 55 (chamber formation plate 30) is sandwiched between the male die 51 and the female die 52, a compressed amount of the material located between the projections 53 and 54 becomes largest.

Figure 14D:
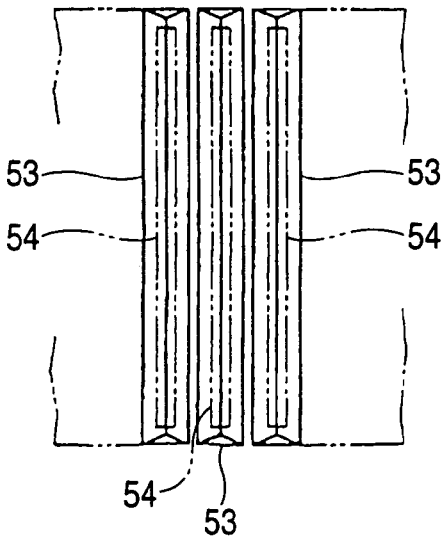
FIG. 14D is a plan view for explaining a positional relationship between a first male die and a female die in the case of FIGS. 14A to 14C.

FIG. 14D shows the positional relationship between the projections 53 indicated by solid lines and the projections 54 by dashed chain lines.

In the elongated recess portion forming steps, first, as shown in FIG. 14A, the strip 55 is mounted at an upper face of the female die 52 and the first male die 51 is arranged on an upper side of the strip 55. Next, as shown in FIG. 14B, the first male die 51 is moved down to push the distal end portion of the projection 53 into the strip 55. At this occasion, since the distal end portion 53*a* of the projection 53 is sharpened in the V-like shape, the distal end portion 53*a* can firmly be pushed into the strip 55 without buckling. Pushing of the projection 53 is carried out up to a middle in a plate thickness direction of the strip 55 as shown in FIG. 14C.

By pushing the projection 53, a portion of the strip 55 flows to form the elongated recess portion 33. In this case, since the distal end portion 53*a* of the projection 53 is sharpened in the V-like shape, even the elongated recess portion 33 having a small shape can be formed with high dimensional accuracy. That is, the portion of the strip 55 pushed by the distal end portion 53*a* flows smoothly, the elongated recess portion 33 to be formed is formed in a shape following the shape of the projection 53. Further, since the both longitudinal ends of the distal end portion 53*a* are tapered, the strip 55 pushed by the portions also flows smoothly. Therefore, also the both end portions in the longitudinal direction of the elongated recess portion 33 are formed with high dimensional accuracy.

Since pushing of the projection 53 is stopped at the middle of the plate thickness direction, the strip 55 thicker than in the case of forming a through hole can be used. Thereby, the rigidity of the chamber formation plate 30 can be increased and improvement of an ink ejection characteristic is achieved. Further, the chamber formation plate 30 is easily dealt with and the operation is advantageous also in enhancing plane accuracy.

A portion of the strip 55 is raised into a space (i.e., the gap 53*b*) between the contiguous projections 53 by being pressed by the projections 53. Here, the nickel material as the material to be plastically worked is numerically defined as described above. For example, the ratio of the grain size of the nickel crystal relative to the thickness of the partition wall 28 is 60% or less; and the Vickers hardness is no less than 50 Hv and less than 190 Hv; the ductility is greater than 5% and less than 20%.

Since such a nickel material is plastically worked between the projections 53 and the projections 54 which are opposed to each other, the parts of the strip 55 most compressed between the projections 53 and the projections 54 is positively flown toward the gaps 53*b*. As a result, relatively high partition walls 28 can be formed.

Since the chamber formation plate 30 is plastically worked under such conditions, more smooth plastic flow can be attained. Since the resultant chamber formation plate 30 is high in the shape and dimensional accuracies, the liquid ejection head 1 having good ejection property is manufactured. Since the numerical definition of the nickel material as mentioned above reduces the load imposed on the forging punch, the durability of the forging punch can be maintained for a long time period.

A second modified example of the step of forming the elongated recess portions will be explained below. In this case, the plastic flow of the material 55 is positively controlled so as to properly form the partition walls 28. A forging punch is caused to comprise a first die and a second die including a preforming die and a finishing die, and a special shape is given to the second die to form the proper partition wall 28.

Figure 15:
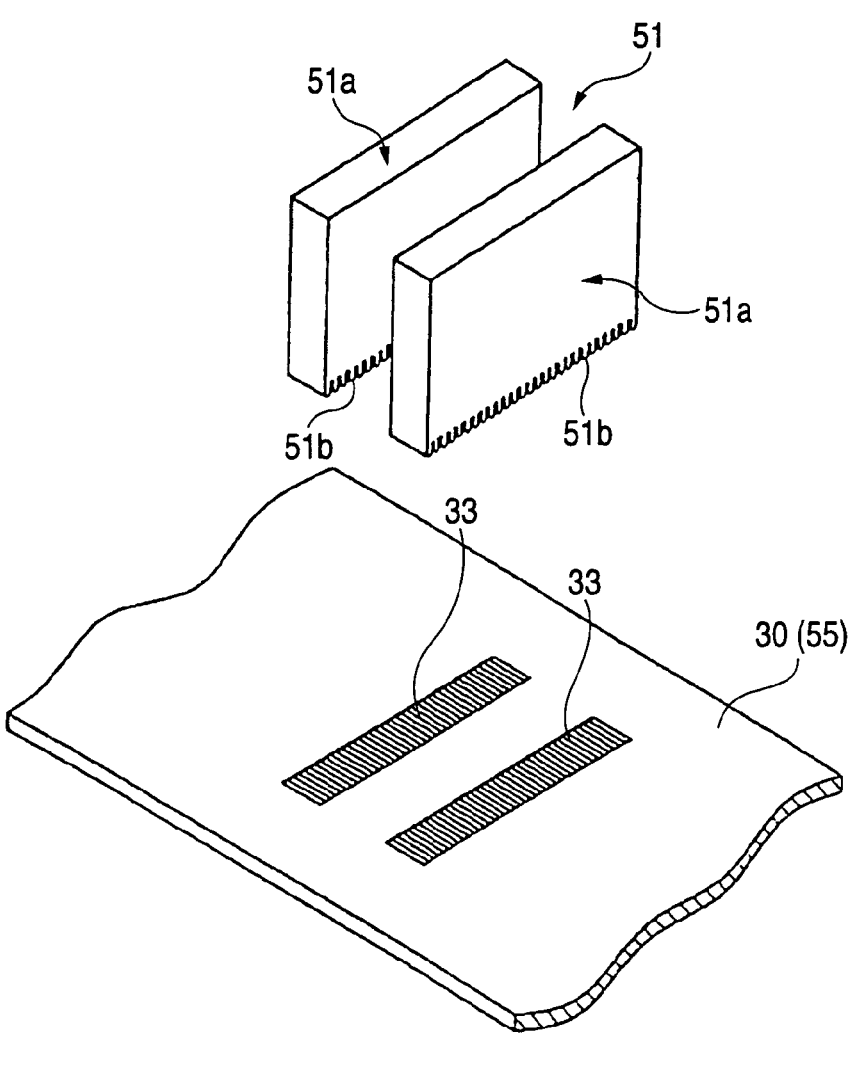
FIG. 15 is a perspective view for explaining a second modified example of the step of forming the elongated recess portions.

As shown in FIG. 15, large number of molding punches 51*b* are arranged in the male die 51*a*, that is, the first die. In order to form the elongated recess portions 33, the molding punches 51*b* are elongated to form projections 53*c*. The projections 53*c* are arranged in parallel at a predetermined pitch. In order to form the partition walls 28, gaps 53*b* (see FIG. 16B) are provided between the molding punches 51*b*. A state in which the first die 51*a* is pushed into the chamber formation plate 30 (strip 55) to be a worked object is shown in FIG. 16C.

In this embodiment, the material (strip) 55 is caused to flow into the gaps 53*b* by the preforming die 63 and the distribution of the material 55 in the gaps 53*b* is caused to approach a normal state as much as possible by the finishing die 64. Consequently, the amount of the flow of the material into the gaps 53*b* is brought into an almost straight state in the longitudinal direction of the gaps 53*b*, which is convenient for the case in which that portions are caused to serve as a member such as the partition wall 28 of the pressure generating chambers 29 of the liquid ejection head 1.

The structure and operation of the second die 52*a* will be described in detail as follows.

Figure 16A:
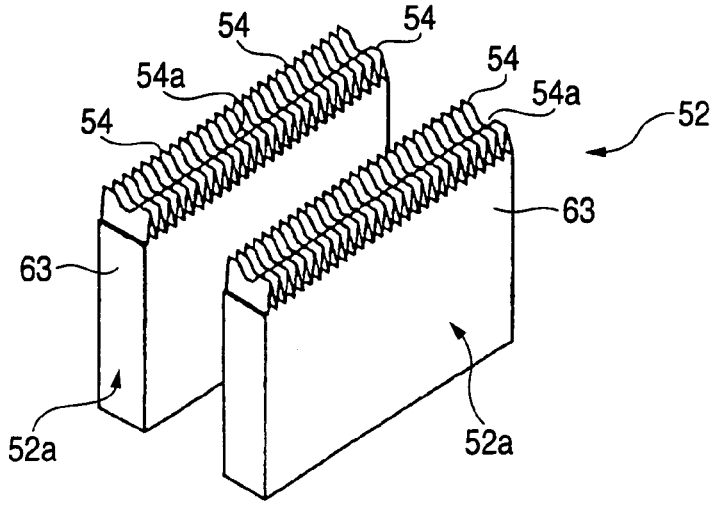
FIG. 16A is a perspective view of a preforming female die used in the case of FIG. 15.

As shown in FIG. 16A, in a female die 52*a*, that is, the second die, each of projections 54 is formed with a concave portion 54*a* at a portion corresponding to the longitudinal middle part of the projection 53*c*. The preforming die 63 is provided with the projections 54 opposed to the gaps 53*b* and having almost the same length as the length of the gaps 53*b*.

FIG. 18A enlargedly shows the concave portion 54*a*. FIG. 18B shows a cross section of a part of the projection 54 other than the concave portion 54*a*. FIG. 18C shows a cross section of a part of the projection 54 where the concave portion 54*a* is formed.

Figure 16B:
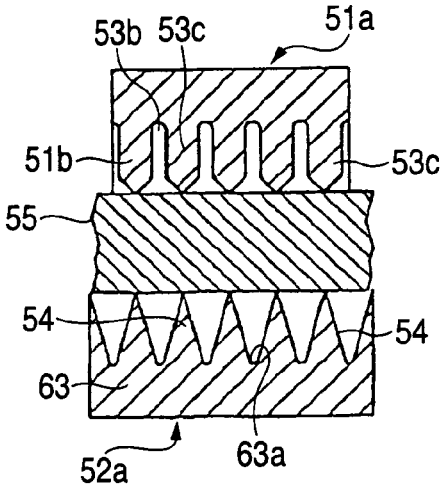
FIGS. 16B and 16C are sectional views showing a primary molding in the case of FIG. 15.
Figure 16C:
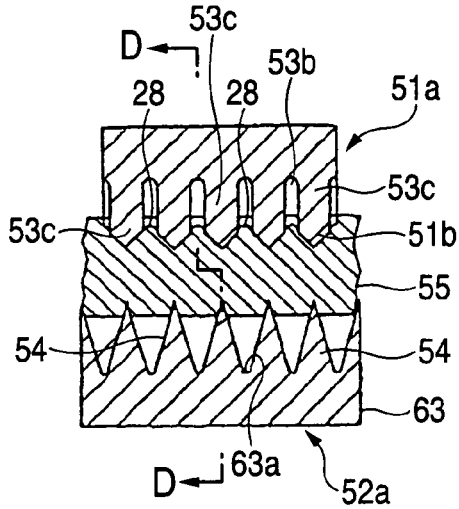

The projection 54 conceptually shown in FIGS. 9A through 10C is a convex member having a small height. In order to form the concave portion 54*a*, a certain height is actually required for the projection 54. In order to obtain such a certain height, each of the projections 54 has a wedge-shaped cross section as shown in FIG. 16B. The angle of the wedge-shaped portion is set to be an angle of 90 degrees or less. Valley portions 56*a* are defined between the adjacent projections 54.

The length of the concave portion 54*a* of the projection 54 in the longitudinal direction is set to be approximately ⅔ of the length of the projection 54 or less. Preferably, it is ½ of the length of the projection 54 or less. The pitch of the projection 54 is set to be 0.14 mm. The pitch of the projection 54 is set to be 0.3 mm or less so that more suitable preforming is carried out in a forging work of a component such as the liquid ejection head. The pitch is preferably 0.2 mm or less and more preferably 0.15 mm or less. Furthermore, at least the concave portion 54*a* of the projection 54 has a surface thereof finished smoothly. For the finishing, mirror finishing is suitable, and furthermore, chromium plating may be carried out.

FIG. 18D shows a first modified example of the preforming die 63 in which the convex portion 54*a* is formed with flat faces. FIG. 18E shows a second modified example of the preforming die 63 in which only bottom corners of the convex portion 54*a* are curved. FIG. 18F shows a third modified example of the preforming die 63 in which the convex portion 54*a* is formed with sloped flat side faces and a flat bottom face. FIG. 18G shows a fourth modified example of the preforming die 63 in which the convex portion 54*b* substantially defines two concave portions 54*b* at both sides thereof. FIG. 18H shows a fifth example of the preforming die 63 in which a top of the convex portion 54*b* shown in FIG. 18G is made flat.

While the projection 54 is wedge-shaped and has a sharp tip portion, a flat top surface 54*c* or a rounded tip portion may be formed as shown in FIG. 18I depending on the moving condition of the material 55.

Figure 17A:
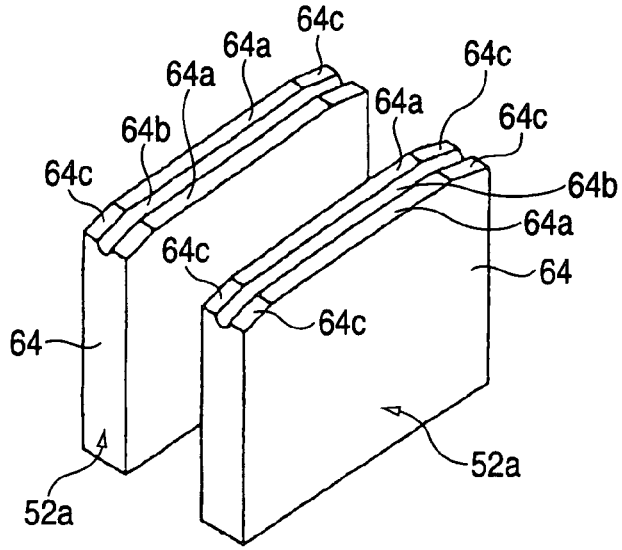
FIG. 17A is a perspective view of a finishing female die used in the case of FIG. 15.

The finishing die 64 is used after the primary molding using the preforming die 63. As shown in FIG. 17A, the finishing die 64 is formed with flat surfaces 64*a* located both sides of a concave portion 64*b*. The flat surfaces 64*a* and the concave portion 64*b* are extended entirely in the longitudinal direction of the finishing die 64. The concave portion 64*b* is located at a part corresponding to the concave portions 54*a* of the projections 54 in the preforming die 63.

Next, description will be given to the operation of the forging punch constituted by the first die 51 a and the second die 52*a*.

FIG. 16B shows a state obtained immediately before the material (strip) 55 is pressurized between the first die 51*a* and the second die 52*a*. When the projections 54 are pressed into the material 55 as shown in FIGS. 16C and 16D, the material is caused to flow into the gaps 53*b* so that the partition wall 28 is preformed.

Incidentally, the second die 52*a* is provided with the concave portion 54*a* having a small height in a middle part. In portions 56*b* close to the ends of the second die 52*a* on both sides of the concave portion 54*a* (see FIG. 16D), an interval D1 between both of the dies 51*a* and 52*a* is smaller than an interval D2 between the middle parts thereof where the concave portion 54*a* is formed. In this narrow portion, the amount of the pressurization of the material is increased so that the material thus pressurized is caused to flow to be pushed out in a direction which is almost orthogonal to the direction of the pressurization. That is, the material is moved toward the concave portion 54*a* in which the amount of the pressurization is smaller. In other words, the concave portion 54*a* serves to provide a place into which the material 55 escapes. Such a material movement is mainly carried out in the longitudinal direction of the projections 53*c* or the gaps 53*b*, so that a part of the material 55 becomes a bulged portion 55*a* which is protruded into the concave portion 54*a*.

Furthermore, a much larger amount of the material 55 is positively pushed into the gaps 53*b* by the contribution of the sufficient height of the projections 54. In the partition wall 28 set in such a preforming state, lower portions 28*a* and a higher portion 28*b* are formed as shown in FIG. 16D. Such a difference in the height is made because a larger amount of the material 55 pressurized in the end portions 56*b* flows to the concave portion 54*a* while a large amount of the material 55 flows into the gaps 53*b* simultaneously.

Figure 16D:
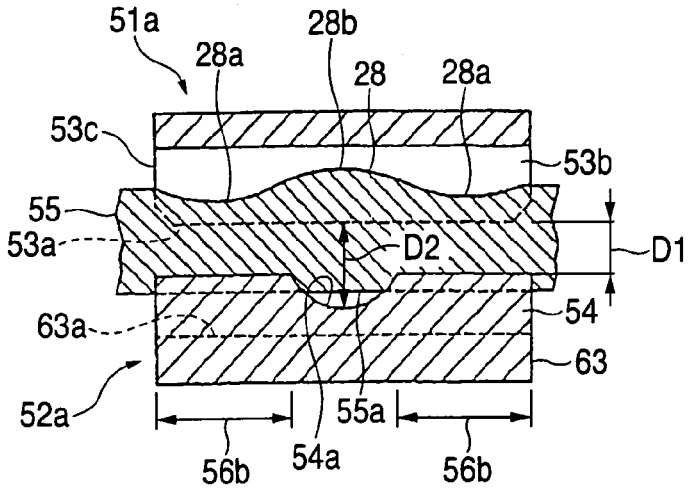
FIG. 16D is a sectional view taken along a line D—D in FIG. 16C.
Figure 17B:
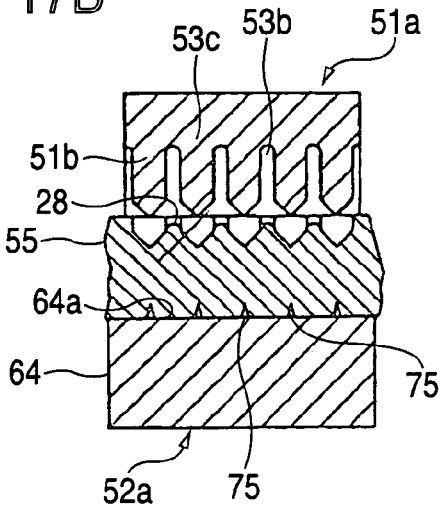
FIGS. 17B and 17C are sectional views showing a secondary molding in the case of FIG. 15.
Figure 17C:
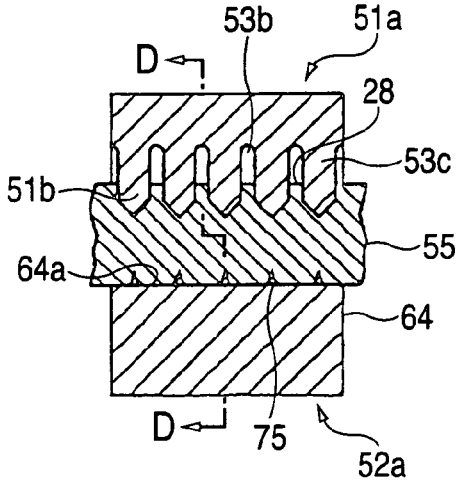
Figure 17D:
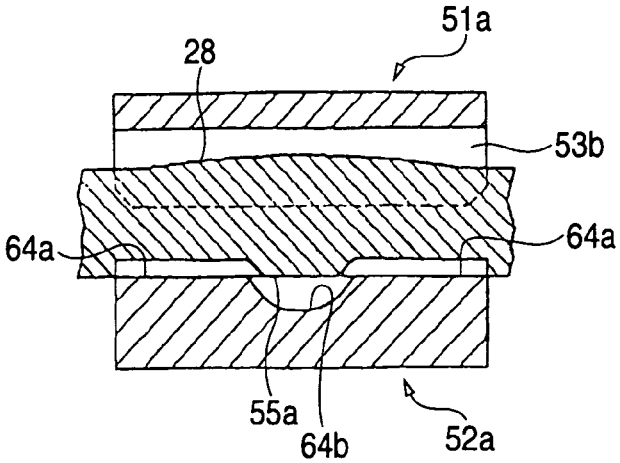
FIG. 17D is a sectional view taken along a line D—D in FIG. 17C.

When the primary molding shown in FIGS. 16C and 16D is completed, the material 55 is moved between the first die 51*a* and the finishing die 64 as shown in FIG. 17B, and is pressurized therein by both of the dies 51*a* and 52*a* as shown in FIG. 17C. The flat surfaces 64*a* increases the amount of the material 55 flowing into the gaps 53*b* so that the heights of the lower portions 28*a* are increased. Incidentally, since the bulged portion 55*a* is accommodated in the concave portion 64*b* and does not receive pressurizing force from the finishing die 64, the height of the higher portion 28*b* is rarely changed. Accordingly, the height of the partition wall 28 finally becomes almost uniform as shown in FIG. 17D.

In the finishing forming stage, since the slope faces 64*c* are formed, the amount of the material 55 flowing into each gaps 53*b* is caused to be as uniform as possible in all the gaps 53*b*. Namely, the material 55 flows in the arrangement direction of the projections 53 little by little from the central part of the array of the projections 53 toward the both ends thereof so that the vicinity of the ends of the material are made thick due to the accumulation of the plastic flow. Since the thick portions are pressurized by the slope faces 64*c* which are lowered, the material in the thick portions can be prevented from excessively flowing into the gaps 53*b*. Accordingly, the amount of the flow of the material 55 can be as uniform as possible in all the gaps 53*b*.

Here, the nickel material as the material to be plastically worked is numerically defined as described above. For example, the ratio of the grain size of the nickel crystal relative to the thickness of the partition wall 28 is 60% or less; and the Vickers hardness is no less than 50 Hv and less than 190 Hv; the ductility is greater than 5% and less than 20%.

Since such a nickel material is plastically worked between the projections 53 and the projections 54 which are opposed to each other, the parts of the strip 55 most compressed between the projections 53 and the projections 54 is positively flown toward the gaps 53*b*. As a result, relatively high partition walls 28 can be formed.

Since the chamber formation plate 30 is plastically worked under such conditions, more smooth plastic flow can be attained. Since the resultant chamber formation plate 30 is high in the shape and dimensional accuracies, the liquid ejection head 1 having good ejection property is manufactured. Since the numerical definition of the nickel material as mentioned above reduces the load imposed on the forging punch, the durability of the forging punch can be maintained for a long time period.

The first die 51*a* and the second die 52*a* are fixed to an ordinary forging device (not shown), and the chamber formation plate 30 (the strip 55) is provided between both of the dies 51*a* and 52*a* so that the forging work is progressively carried out. Moreover, the second die 52*a* is constituted by the preforming die 63 and the finishing die 64 in pairs. Therefore, it is preferable that the preforming die 63 and the finishing die 64 are arranged adjacently to each other so that the chamber formation plate 30 (the strip 55) is sequentially moved.

Figure 19:
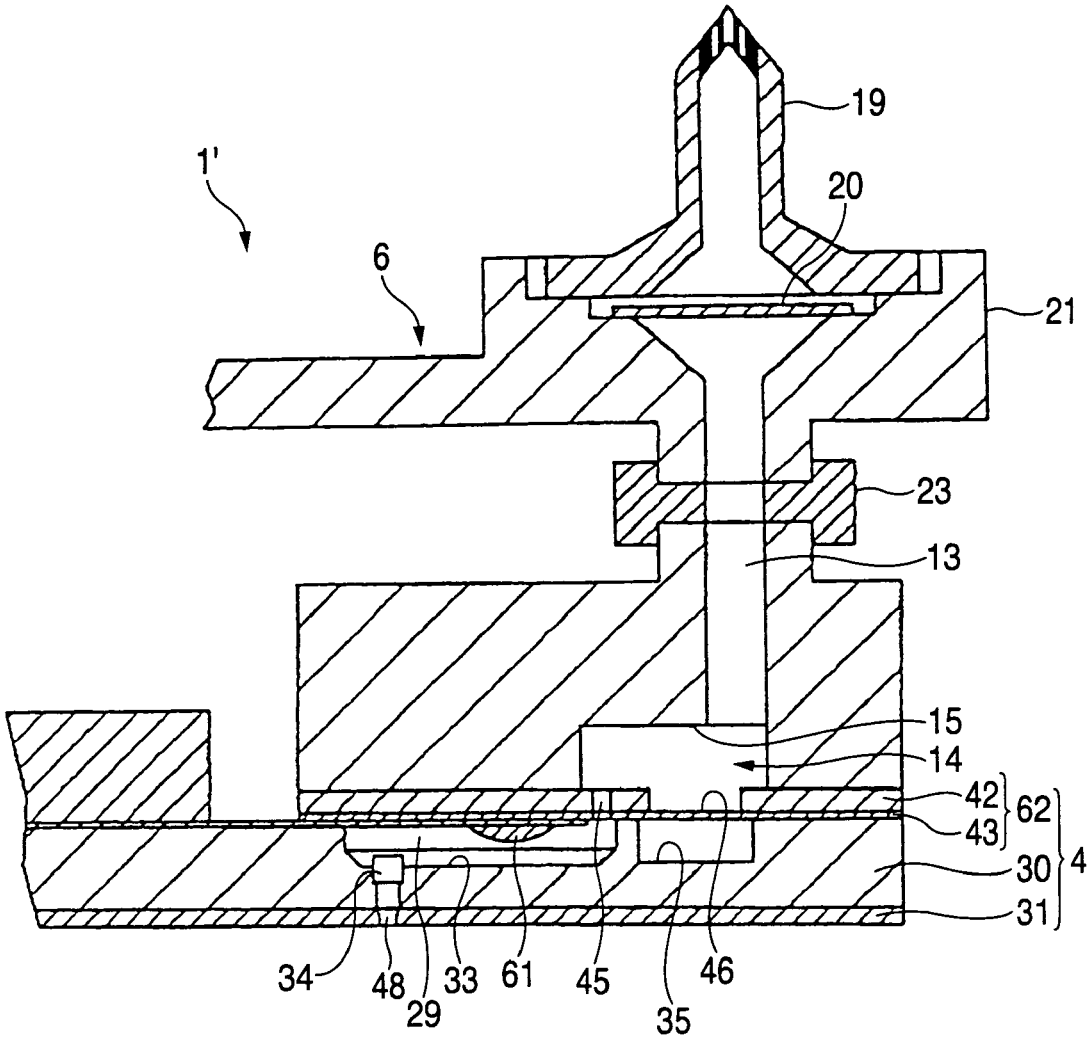
FIG. 19 is a sectional view for explaining an ink jet recording head according to a second example.

As a second example, a recording head 1' shown in FIG. 19 adopts a heat generating element 61 as the pressure generating element. According to the embodiment, in place of the elastic plate 32, a sealing board 62 provided with the compliance portion 46 and the ink supply port 45 is used and the side of the elongated recess portion 33 of the chamber formation plate 30 is sealed by the sealing board 62. Further, the heat generating element 61 is attached to a surface of the sealing board 62 at inside of the pressure generating chamber 29. The heat generating element 61 generates heat by feeding electricity thereto via an electric wiring.

Since other constitutions of the chamber formation plate 30, the nozzle plate 31 and the like are similar to those of the above-described embodiments, explanations thereof will be omitted.

In the recording head 1', by feeding electricity to the heat generating element 61, ink at inside of the pressure generating chamber 29 is bumped and bubbles produced by the bumping presses ink at inside of the pressure generating chamber 29, so that ink drops are ejected from the nozzle orifice 48.

Even in the case of the recording head 1', since the chamber formation plate 30 is fabricated by plastic working of metal, advantages similar to those of the above-described embodiments are achieved.

With regard to the communicating port 34, although according to the above-described embodiments, an example of providing the communicating port 34 at one end portion of the elongated recess portion 33 has been explained, the invention is not limited thereto. For example, the communicating port 34 may be formed substantially at center of the elongated recess portion 33 in the longitudinal direction and the ink supply ports 45 and the common ink reservoirs 14 communicated therewith may be arranged at both longitudinal ends of the elongated recess portion 33. Thereby, stagnation of ink at inside of the pressure generating chamber 29 reaching the communicating port 34 from the ink supply ports 45 can be prevented.

Further, although according to the above-described embodiments, an example of applying the invention to the recording head used in the ink jet recording apparatus has been shown, an object of the liquid ejection head to which the invention is applied is not constituted only by ink of the ink jet recording apparatus but glue, manicure, conductive liquid (liquid metal) or the like can be ejected.

For example, the invention is applicable to a color filter manufacturing apparatus to be used for manufacturing a color filter of a liquid-crystal display. In this case, a coloring material ejection head of the apparatus is an example of the liquid ejection head. Another example of the liquid ejection apparatus is an electrode formation apparatus for forming electrodes, such as those of an organic EL display or those of a FED (Field Emission Display). In this case, an electrode material (a conductive paste) ejection head of the apparatus is an example of the liquid ejection head. Still another example of the liquid ejection apparatus is a biochip manufacturing apparatus for manufacturing a biochip. In this case, a bio-organic substance ejection head of the apparatus and a sample ejection head serving as a precision pipette correspond to examples of the liquid ejection head. The liquid ejection apparatus of the invention includes other industrial liquid ejection apparatuses of industrial application.

What is claimed is:

1. A liquid ejection head, comprising:

a chamber formation plate, having a first face formed with a plurality of recesses arranged in a first direction at a fixed pitch, such that each of the recesses is communicated with, via a through hole, a second face which is an opposite face of the first face, the chamber formation plate comprised of nickel;

a sealing plate, joined to the first face of the chamber formation plate so as to seal the recesses to form a plurality of pressure generating chambers; and a metallic nozzle plate, formed with a plurality of nozzles, and joined to the second face of the chamber formation plate such that each of the nozzles is communicated with associated one of the pressure generating chamber via the through hole, wherein a ratio of a grain size of a crystal of the nickel with respect to a thickness of a partition wall defined between each adjacent ones of the recesses is 60% or less.

2. The liquid ejection head as set forth in claim 1, wherein the thickness of the partition wall falls within a range of 20 μm to 50 μm.

3. The liquid ejection head as set forth in claim 2, wherein the grain size is no less than 5 μm and less than 25 μm.

4. The liquid ejection head as set forth in claim 1, wherein a Vickers hardness of the nickel is no less than 150 Hv and less than 190 Hv.

5. The liquid ejection head as set forth in claim 1, wherein a ductility of the nickel is greater than 5% and less than 20%.

6. The liquid ejection head as set forth in claim 1, wherein a ratio of a height of the partition wall with respect to the thickness of the partition wall falls within a range of 1.0 to 2.1.

7. The liquid ejection head as set forth in claim 1, wherein a ratio of a width of each of the recesses with respect to the thickness of the partition wall falls within a range of 2.0 to 5.0.

8. The liquid ejection head as set forth in claim 1, wherein a ratio of a depth of each of the recesses with respect to the thickness of the partition wall falls within a range of 2.0 to 4.5.

9. The liquid ejection head as set forth in claim 1, wherein:

a bottom of each of the recesses has a V-shaped cross section when viewed from a second direction perpendicular to the first direction; and an angle between faces forming the V-shaped cross section falls within a range of 45 degrees to 110 degrees.

10. The liquid ejection head as set forth in claim 1, wherein the fixed pitch is 0.3 mm or less.

11. The liquid ejection head as claimed in claim 1, wherein the chamber formation plate has a single layer structure.

12. A liquid ejection head, comprising:

a first pressure generating chamber;

a second pressure generating chamber disposed adjacent to the first pressure generating chamber;

a partition wall formed between the first pressure generating chamber and the second pressure generating chamber;

a first nozzle that communicates with the first pressure generating chamber via a first through hole; and a second nozzle that communicates with the second pressure generating chamber via a second through hole, wherein the partition wall comprises nickel having a particle size, and wherein the partition wall has a thickness defined in a direction from the first pressure generating chamber to the second pressure generating chamber, and wherein a ratio of the particle size to the thickness is 60% or less.

13. The liquid ejection head as claimed in claim 12, comprising:

a chamber formation plate having a first face and a second face that is opposite to the first face, wherein a first recess and a second recess are formed in the first face and form part of the first pressure generating chamber and the second pressure generating chamber, respectively, wherein the partition wall is part of the chamber formation plate between the first recess and the second recess, and wherein the chamber formation plate comprises the nickel having the particle size; and a metallic nozzle plate in which the first nozzle and the second nozzle are formed, wherein the first through hole and the second through hole create openings in the second face to enable the first nozzle and the second nozzle to respectively communicate with the first recess and the second recess.

14. The liquid ejection head as claimed in claim 13, wherein a width of the first recess to the thickness of the partition wall is between 2.0 and 5.0.

15. The liquid ejection head as claimed in claim 13, wherein a depth of the first recess to the thickness of the partition wall is between 2.0 and 4.5.

16. The liquid ejection head as claimed in claim 13, wherein a bottom of the first recess and the second recess has a V-shaped cross section when viewed along a length of the first recess and the second recess.

17. The liquid ejection head as claimed in claim 16, wherein an angle between faces forming the V-shaped cross section is between 45 degrees and 110 degrees.

18. The liquid ejection head as claimed in claim 12, wherein the thickness of the partition wall is between 20 microns and 50 microns.

19. The liquid ejection head as claimed in claim 18, wherein the particle size is between 5 microns and 25 microns.

20. The liquid ejection head as claimed in claim 12, wherein a Vickers hardness of the nickel is between 150 Hv and 190 Hv.

21. The liquid ejection head as claimed in claim 12, wherein a ductility of the nickel is between 5% and 20%.

22. The liquid ejection head as claimed in claim 12, wherein a ratio of a height of the partition wall to the thickness of the partition wall is between 1.0 and 2.1.

* * * * *